US006322689B1

(12) United States Patent
Omasa

(10) Patent No.: US 6,322,689 B1
(45) **Date of Patent: *Nov. 27, 2001**

(54) ANODIZING METHOD AND APPARATUS FOR PERFORMING THE SAME

(75) Inventor: Ryushin Omasa, Fujisawa (JP)

(73) Assignee: Japan Techno Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/536,844

(22) Filed: Mar. 28, 2000

(30) Foreign Application Priority Data

Apr. 2, 1999 (JP) ..... 11-096832

(51) Int. Cl.[7] ..... C25D 17/00

(52) U.S. Cl. ..... 205/324; 205/316; 205/323; 204/222; 204/273

(58) Field of Search ..... 204/222, 273; 205/671, 324, 316–333

(56) References Cited

U.S. PATENT DOCUMENTS

| | | |
|---|---|---|
| 3,933,601 | 1/1976 | Ishibashi et al. . |
| 3,983,014 | 9/1976 | Newman et al. . |
| 5,480,675 | 1/1996 | Murakami et al. . |
| 5,534,296 | 7/1996 | Rieger . |
| 5,785,838 | 7/1998 | Sugimura et al. . |
| 6,123,815 * | 9/2000 | Omasa ..... 204/222 |

FOREIGN PATENT DOCUMENTS

| | | |
|---|---|---|
| 38 42 600 A1 | 12/1988 | (DE) . |
| 1 374 787 A | 11/1974 | (GB) . |
| 60-9600 | 7/1979 | (JP) . |
| 3-275130 (A) | 12/1991 | (JP) . |
| 06220697 A | 8/1994 | (JP) . |
| 06304461 A | 11/1994 | (JP) . |
| 06312124 A | 11/1994 | (JP) . |
| 06330395 A | 11/1994 | (JP) . |
| 08173785 A | 7/1996 | (JP) . |
| 09040482 A | 2/1997 | (JP) . |

OTHER PUBLICATIONS

Abstrct from Brazilian Application No. PI9400839–6A, published Oct. 24, 1995.
Abstract XP002144996 from Japanese Application JP 54 084840 A dated Jun. 7, 1979.

* cited by examiner

*Primary Examiner*—Robert Dawson
*Assistant Examiner*—Michael J Feely
(74) *Attorney, Agent, or Firm*—Pitney, Hardin, Kipp & Szuch, LLP

(57) ABSTRACT

An anodizing method of a metal body which includes an anodizing treatment process performed while vibrationally fluidly stirring and aerating a treatment bath in which the metal body is vibrated and swung and an apparatus for performing the same.

19 Claims, 14 Drawing Sheets

ANODIZING METHOD AND APPARATUS FOR PERFORMING THE SAME

BACKGROUND OF THE INVENTION

1. Field of the Invention

The present invention relates to an anodizing method of a metal body using vibrationally, fluidly stirring and an apparatus for performing the same.

2. Description of the Related Art

In the field of manufacturing metal articles such as those made of aluminum, aluminum alloy, magnesium, magnesium alloy, etc. having an anodic oxide film on the surface of a metal body by using the anodizing process, it has been required to reduce the energy consumption and to improve the productivity and, in particular, to realize speeding up of the anodizing process, improvement in efficiency of oxide film forming. Furthermore, it has been required to realize the speeding up of the anodizing process under the condition that the higher temperature or room temperature treatment bath is used.

In fact, the most significant problem in the conventional anodizing process is that very long period of process time is necessary even if thinner oxide film having the thickness of 10 to 15 $\mu$m is formed. Therefore, in the manufacturing line for the metal article, for example a sash window, made of anodized aluminum, the anodizing process must be performed with use of a plurality of treatment apparatuses arranged in parallel to each other in order to avoid stagnation of the line, because the anodizing process takes about 10 to 15 times of the duration of time as compared with the pre-treatment process and post-treatment process.

The inventor has proposed an anodizing process in which micro bubbles having a diameter of 50 to 80 $\mu$m are continuously supplied to the treatment surface of alumimum body so that the anodizing rate is increased to the extent of 2 to 3 times of that of the conventional anodizing process. However, this process is still insufficient in the treatment rate and the treatment temperature.

On the other hand, in Japanese Patent Application Publication No. Sho-60-9600, there is disclosed an anodizing method in which numerous bubbles having a diameter of 0.001 to 4 mm are generated by the aeration apparatus in the electrolytic bath, and the bubbles are subjected to vibration of frequency of 10 to 200 Hz and allowed to move upwardly so that the efficiency of the anodizing process is improved. However, this technique is still insufficient, because oxygen generated by the electrolysis around the anode tends to form bubbles which is transferred to the atomosphere, and therefore the oxidative function thereof on the metal body becomes lowered. In addition, oxygen bubble formation results in increase of electrical resistance of the surface of the metal body and the higher voltage is required for the treatment so that the greater electric power is necessary and thus the heat release and energy loss become greater. Accordingly, it is considered that this conventional technique is practically used with the lower current density, for example 2 to 3 A/dm$^2$, and therefore cannot realize the speeding up of the anodizing process under the condition that the higher temperature or room temperature treatment bath is used.

SUMMARY OF THE INVENTION

An object of the present invention is to provide an anodizing method with higher anodizing rate, less energy consumption and higher efficiency of oxide film formation.

Another object of the present invention is to provide an anodizing method in which an excellent, uniform oxide film can be obtained without burning of the metal body even if the metal body has a complicated profile.

According to a first aspect of the present invention, in order to attain the above object, there is provided an anodizing method of a metal body, comprising an anodizing treatment process in which an anodic oxide film is formed on a surface of the metal body immersed in a treatment bath, the anodizing treatment process being performed while the following steps (a) and (b) are simultaneously carried out:

(a) a step of vibrationally fluidly stirring the treatment bath, wherein the treatment bath is vibrationally fluidly stirred by vibrating a vibration vane at an amplitude from 0.5 to 3.0 mm and at a vibrational frequency of 200 to 800 times per minute; and (b) a step of performing an aeration in the treatment bath by using air bubbles generated by a diffuser having a pore opening of 10 to 400 $\mu$m.

In the anodizing method, the anodizing treatment process may be performed while at least one of the following steps (c) and (d) are simultaneously carried out:

(c) a step of applying vibration to the metal body, wherein the metal body is vibrated at an amplitude from 0.5 to 1.0 mm and at a frequency of 100 to 300 times per minute; and (d) a step of swinging the metal body, wherein the metal body is swung at a swing amplitude from 10 to 100 mm and at a swing frequency of 10 to 30 times per minute.

According to a second aspect of the present invention, there is provided an anodizing method, comprising an anodizing treatment process in which an anodic oxide film is formed on a surface of a metal body immersed in a treatment bath, the anodizing treatment process being performed while the following apparatuses (A) and (B) are simultaneously operated:

(A) a vibrationally fluidly stirring apparatus for the treatment bath, which comprises a vibration generating means containing a vibration motor, a vibrationally fluidly stirring means for vibrating a vibration vane at an amplitude of 0.5 to 3.0 mm and at a vibrational frequency of 200 to 800 times per minute to generate vibrational flow in the treatment bath, the vibration vane being fixed in one stage or in multistage to a vibrating bar which vibrates in the treatment bath interlockingly with the vibration generating means, and a vibration stress dispersing means at a connection portion of the vibration generating means and the vibrationally fluidly stirring means; and (B) an aeration apparatus for the treatment bath, which comprises a ceramic diffusing pipe having a pore-size of 10 to 400 $\mu$m.

The apparatus (A) further comprises an inverter for controlling the vibration motor of the apparatus (A) to generate any frequency in the range from 10 to 500 Hz. The power of the vibration motor is set to an appropriate value according to volume of the treatment bath.

The ceramic diffusing pipe of the apparatus (B) may have a porosity of 30 to 40%. For example, in case of a diffusing pipe which is obtained by forming many holes each having a pore size of about 1 mm in a pipe of synthetic resin such as PVC, electrolytic heat cannot be effectively removed because air bubble size is excessively large, and there occurs a dispersion in electrical resistance of the system. On the other hand, the aeration apparatus (B) according to the present invention uses a ceramic porous pipe as a diffusing pipe, and thus the above problem can be avoided, that is, Joule heat generated in the system can be removed. A high-temperature sintered ceramic pipe which contains alumina grain such as ALUNDUM (trade name) as bone material is preferably used as the ceramic porous pipe. The pore-size of the diffusing pipe is suitably set to 10 to 400 $\mu$m, preferably 10 to 120 $\mu$m, and the porosity (the ratio of the area of pores to the surface area) is preferably set to about 30 to 40%. The outer diameter of the diffusing pipe is typically set to 50 to 100 mm, and the length thereof is typically set to about 1000 to 1500 mm although it is varied in accordance with the length of the treatment tank. A method of disposing the diffusing pipe is not limited to a specific one, however, if plural diffusing pipes are used, they are disposed so that the air bubbles generated by the aeration come around the metal body uniformly. The interval between the diffusing pipes is preferably set to 100 to 120 mm, and the interval in the vertical direction between the diffusing pipe and the metal body is preferably set to 100 to 300 mm. According to such an arrangement, the aeration can be strengthened as twice degree as compared with the conventional aeration.

In the anodizing method, the anodizing treatment process may be performed while at least one of the following apparatuses (C) and (D) are simultaneously operated:

(C) an apparatus for applying vibration to the metal body through an electrode bar on which the metal body is hung in an amplitude from 0.5 to 1.0 mm and at a frequency of 100 to 300 times per minute; and (D) an apparatus for swinging an electrode bar for suspending the metal body thereon, which generates a swinging motion of the metal body at a swinging amplitude of 10 to 100 mm and a frequency of 10 to 30 times per minute through the electrode bar.

The apparatus (C) may use a vibration motor whose frequency is adjusted to 10 to 60 Hz by an inverter to generate the vibration. The frequency (Hz) of the vibration motor of the apparatus (C) for inducing oscillation to the electrode bar is preferably set to 50 to 65% of the frequency of the vibration motor of the apparatus (A). Specifically, the frequency of the vibration motor of the apparatus (C) is preferably set to 20 to 35 Hz. This oscillation also vibrates the metal body, however, it does not cause flow of treatment liquid.

The swing motion of the apparatus (D) which is applied through the electrode bar on which the metal body is suspended is preferably set so as to have a swing width of preferably 20 to 60 mm.

According to a third aspect of the present invention, there is provided an anodizing apparatus for performing the anodizing treatment process, comprising the apparatuses (A) and (B). The anodizing apparatus may comprise at least one of the apparatuses (C) and (D).

According to the present invention, since both the apparatuses (A) and (B) are simultaneously operated, the anodizing process can be performed with good stability under an increased current density of about 10 to 15 A/dm$^2$ and significantly reduced anodizing treatment time as compared with the conventional anodizing process in which only the aeration apparatus is used.

In the anodizing process, the treatment temperature is an important factor on the energy cost of the process and on the quality of the oxide film obtained. In the conventional anodizing method which is performed with use of the aeration, the temperature of −5 to 0° C. is necessary for forming the hard anodic oxide film and the temperature of 20° C. or less is preferable for forming the general anodic oxide film. On the other hand, according to the present invention, the temperature of 10 to 20° C. can be used for forming the hard anodic oxide film and the temperature of 30 to 35° C. can be used for forming the general anodic oxide film, resulting in the reduced energy cost in cooling the treatment bath and the excellent quality of the oxide film even in case of higher temperature than that of the conventional method.

The inventor has proposed to use a vibrationally fluidly stirring apparatus in the plating bath in Japanese Patent Publication No. Hei-6-71544 and Japanese Patent Laid-open Publication No. Hei-6-220697. In the plating, the plating target is functions as cathode, and the metal ion supplied by anode and existing in the plating bath is deposited on the cathode as a metal film. In the plating, water is subjected to electrolysis to generate hydrogen on the surface of the cathode. The hydrogen tends to form bubble which causes the increase of electrical resistance and lowers the electric current efficiency, and thus the deposition of the metal ion on the cathode is inhibited and the plating treatment time is increased. In the above Japanese Patent Publication No. Hei-6-71544, the vibrationally fluidly stirring apparatus is used for the purpose of removing the hydrogen on the surface of the cathode so as to avoid the inhibition of the metal deposition caused by hydrogen bubbles.

On the other hand, in the anodizing process, a treatment target, i.e. metal body, functions as anode. This is opposite to the case of plating process. The hydroxide ion generated by the electrolysis and attracted toward the anode is decomposed by electrical discharge to generate oxygen which is used to oxidize the surface of the metal body, i.e. anode, so as to form the oxide film on the surface of the metal body. Thus the oxygen preferably remain around the anode. Accordingly, it has been considered that the use of the above-mentioned vibrationally fluidly stirring apparatus in the anodizing bath would be useless because the vibrationally fluidly stirring apparatus would remove the oxygen bubble around the anode to lower the anodizing efficiency.

However, the inventor has found out with great surprise that the anodic oxide film having good denseness and uniformity was formed with higher anodizing rate as compared with the conventional method, when the vibrationally fluidly stirring apparatus was used in the anodizing bath. The inventor considers that, in case of using the vibrationally fluidly stirring apparatus (A), the oxygen generated by the elecrolysis does not form bubble but remains as the nascent oxygen around the anode to react on the anode with excellent efficiency.

As mentioned in the above, the plating process and the anodizing process are different techniques from each other, and therefore the effects of use of the above vibrationally fluidly stirring apparatus (A) in the anodizing process is not obvious in the prior art.

The metal body, i.e. treatment target of the anodizing process, is made of aluminum, aluminum alloy, magnesium, magnesium alloy, titanium, titanium alloy, niobium, niobium alloy, tantalum, tantalum alloy, zirconium, zirconium alloy, lead, lead alloy, for example. Examples of the aluminum alloy are Al—Si, Al—Mg, Al—Mg—Si, Al—Zn. The metal body may have a blind hole or dimple having a diameter equal to or less than 10 mm or a through hole having a diameter equal to or less than 10 mm.

The treatment bath, i.e. electrolytic bath, used in the anodizing process of the present invention is an acidic bath containing chromic acid, boric acid, boric ammonium, sulfuric acid, phosphoric acid, oxalic acid, benzenesulfonic acid, sulfamic acid, citric acid, tartaric acid, formic acid, or succinic acid, or, the combination thereof, for example.

In the method of the present invention, a pre-treatment process may be performed as usual before the anodizing treatment process. Examples of the pre-treatment process are as follows:

(a) degreasing—water washing (b) degreasing—water washing (—etching—water washing)—desmutting—water washing (c) mechanical polishing—degreasing—water washing (d) mechanical polishing—degreasing—water washing—etching—water washing—desmutting—water washing (e) degreasing—water washing—electrolytic polishing or chemical polishing—water washing—oxide removing or desmutting—water washing (f) mechanical polishing—degreasing—water washing—electrolytic polishing or chemical polishing—water washing—oxide removing or desmutting—water washing In the method of the present invention, a post-treatment process may be performed as usual after the anodizing treatment process. Example of the post-treatment process comprises a sealing step for treating the porous surface of the metal body. The sealing step can be performed by steam sealing, metal salt sealing, electrodeposition sealing, dye sealing, or pigment sealing, or, the combination thereof.

The line of the pre-treatment process, the anodizing process and the post-treatment process of the anodizing method of the metal body made of aluminum or aluminum alloy comprises the steps as shown in the following Table 1, in which the agent and treatment condition for each step are also shown:

TABLE 1

| Step | Agent used | Treatment condition | |
|---|---|---|---|
| (1) Degreasing | Organic solvent | 40° C. | 5 min. |
| (2) Washing | Water | Room Temperature | 1 min. |
| (3) Etching | NaOH (50 g/liter) | Room Temperature | 5 min. |
| (4) Washing | Water | Room Temperature | 1 min. |
| (5) Desmutting | $HNO_3$ (5%) | Room Temperature | 1 min. |
| (6) Washing | Water | Room Temperature | 1 min. |
| (7) Anodizing | $H_2SO_4$ (200 g/liter) | Room Temperature | 5 min. |
| (8) Washing | Water | Room Temperature | 1 min. |
| (9) Sealing | Pure Water | 95° C. | 15 min. |
| (10) Drying | | Natural drying | 10 min. |

The degreasing step may be performed by washing the metal body with the organic solvent such as benzine, surfactant water solution, acid water solution such as 5 to 25 W/V% sulfuric acid solution, alkaline water solution such as 5 to 20 W/V% NaOH solution or phosphate water solution.

The etching step may be performed by alkaline process with use of 5 to 25 W/V% NaOH, alkaline phosphate process with use of 3 to 8 W/V% NaOH and 5 to 10 W/V% sodium phosphate, or chromium sulfate process.

The anodizing step may be performed with the ratio of the metal body to the treatment bath of 4 g/liter. In this step, phosphoric acid, oxalic acid, etc. or the combination thereof may be used instead of sulfuric acid. The treatment time varies according to the thikness of the oxide film formed.

In the anodizing method of the present invention, preferably, at least one step, especially the degreasing step and the sealing step, included in the pre-treatment process or the post-treatment process is performed while the apparatus (A) is operated. Preferably, the apparatus (B) is also simultaneously operated. Preferably, at least one of the apparatuses (C) and (D) is also simultaneously operated.

When the vibrationally fluidly stirring apparatus (A) is operated in the anodizing step, surface tension of the treatment bath is lowered so that active oxygen generated on the surface of the metal body or the treatment target well become in contact with the metal body, i.e. anode, without forming bubbles, and the surface of the metal body is oxidized at a rate of several times, e.g. 5 times, of that of the conventional anodizing process to form the anodic oxide film with excellent uniformity.

According to the present invention, a great amount of bubbles generated by the ceramic diffusing pipe move upwardly in the treatment bath while the overall treatment target is enveloped by the bubbles, and then discharged to the outside. Therefore, the electrolytic heat (Joule heat) is effectively absorbed by the bubbles to cool the treatment target rapidly, and also air and dust which are removed from the micropores of the treatment target can be effectively discharged with the bubbles, so that burning or burnt deposits does not occur in the treatment target and thus the oxide film has an excellent uniformity. In order to effectively discharge the Joule heat, the amount of air supplied to the treament bath of 160 liter is preferably 120 liter/min. or more.

In the anodizing process, the reaction heat is generated by the anodizing oxidation, and therefore the treatment bath is cooled to maintain the temperature thereof constant. A heat exchanger is used as a cooling apparatus, and the treatment bath is circulated via the heat exchanger.

It is known that the quality of the oxide film of $\gamma$-$Al_2O_3.H_2O$ which is formed on the surface of the metal body made of aluminum or aluminum alloy is deteriorated as the temperature of the treatment bath increases. It is also known that the oxide film is cracked if the temperature of the treatment bath is excessively low. The oxide film formed according to the present invention is superior to the conventional anodic oxide film obtained under the same temperature condition. In addition, according to the present invention, the oxide film superior to the conventional anodic oxide film can be obtained under the temperature condition of higher by 10 to 15° C. than the conventional process.

In the present invention, the temperature of the treatment bath is 35° C. or below, preferably the room temperature of about 30° C. for the general aluminum oxide film; 20° C. or below, preferably about 15° C. for the general aluminum alloy oxide film; and 10 to 15° C. for the hard oxide film.

According to the present invention, (1) treatment time of the anodizing process can be significantly reduced with the anodizing rate of about 3 to 5 times of that of the conventional anodizing process without occurrence of burning or burnt deposits, resulting in energy saving; the treatment time of entire processes including the pre-treatment process through the post-treatment process can be furthermore reduced if the apparatus (A) is used in the pre-treatment process or post-treatment process, wherein preferably the apparatus (B) is also used, more preferably the apparatuses (C) and/or (D) are also used;

(2) anodic oxide film obtained has a greater Vickers hardness;

(3) anodic oxide film obtained has an excellent uniformity; thus the present invention is advantageous in manufacturing OPC drum;

(4) the anodizing process can be performed at the temperature greater by 5 to 10° C. than that of the conventional process to obtain the oxide film of the same quality. For example, the treatment temperatures of −5 to 5° C. for forming hard anodic oxide film and about 20° C. for forming general anodic oxide film are necessary in the conventional process, whereas the treatment temperatures of 10 to 15° C. for forming the hard anodic oxide film and 30 to 35° C. for forming the general anodic oxide film are available in the present invention and thus it is sufficient to use cooling apparatus of smaller duty;

(5) even if metal body has blind holes or through holes having the inner diameter of 10 mm or less, anodic oxide film can be readily formed on the surface of the metal body including the inner surface of blind holes or through holes with excellent uniformity; thus the present invention is advantageous in manufacturing metal articles having complicated profile such as metal plates having irregular surface, parts of engine, parts of heat exchanger, etc;

(6) anodic oxide film obtained has gloss, hardness, wearing characteristics, weathering characteristics and corrosion resistance higher than that of the oxide film obtained by the conventional process with the same treatment temperature;

(7) amount of air supplied to the treatment bath by aeration can be steeply increased by using the vibrationally fluidly stirring apparatus in combination so that the temperature of the treatment bath can be lowered and the current density can be increased, whereas in the conventional process without using the vibrationally fluidly stirring apparatus the amount of air supplied by the aeration is restricted to a lower value in order to obtain uniform anodic oxide film; and (8) anodic oxide film obtained has a good dyeability.

DETAILED DESCRIPTION OF THE PREFERRED EMBODIMENT

Figure 1:
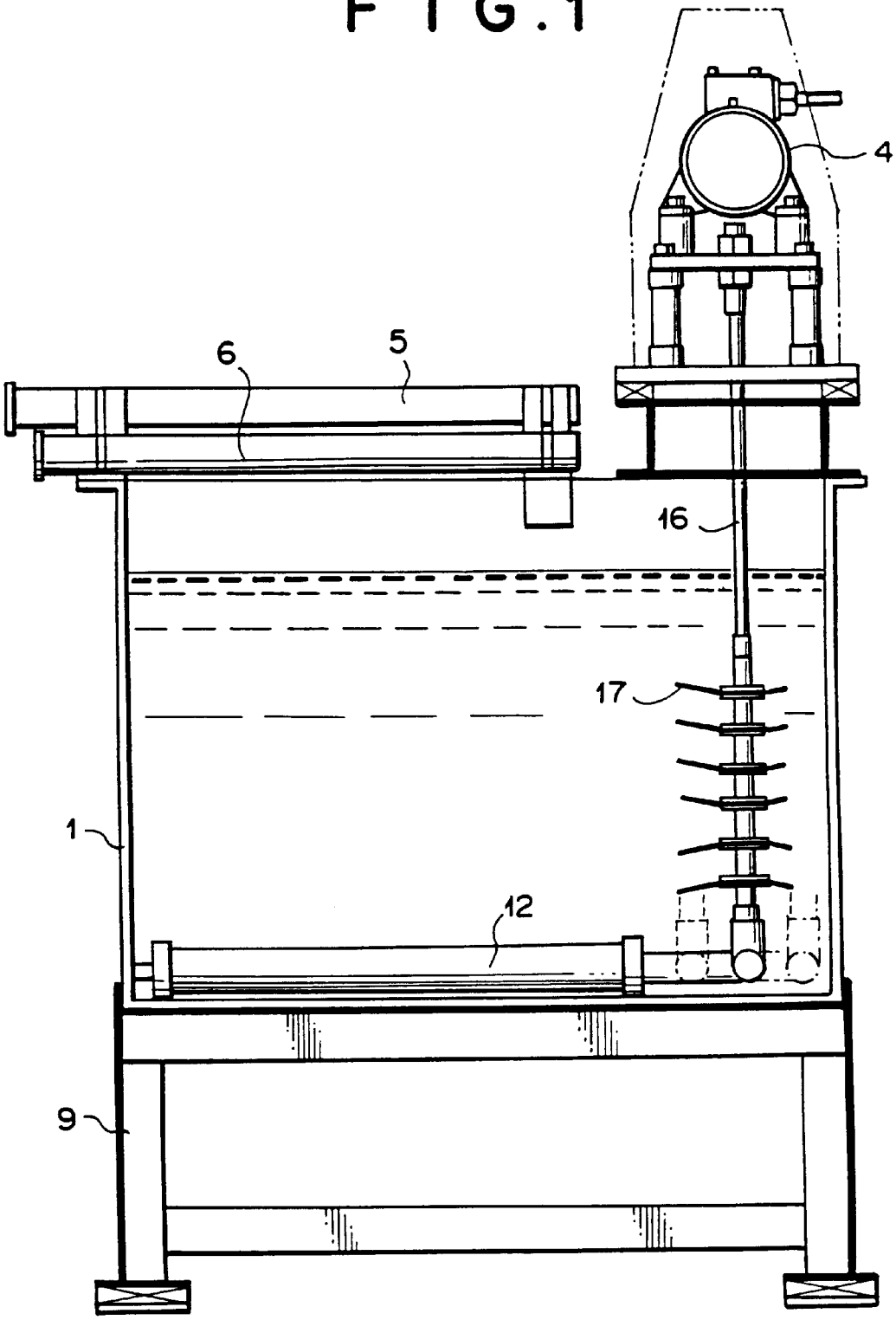
FIG. 1 is a cross-sectional view showing an embodiment of an apparatus used in the present invention.
Figure 2:
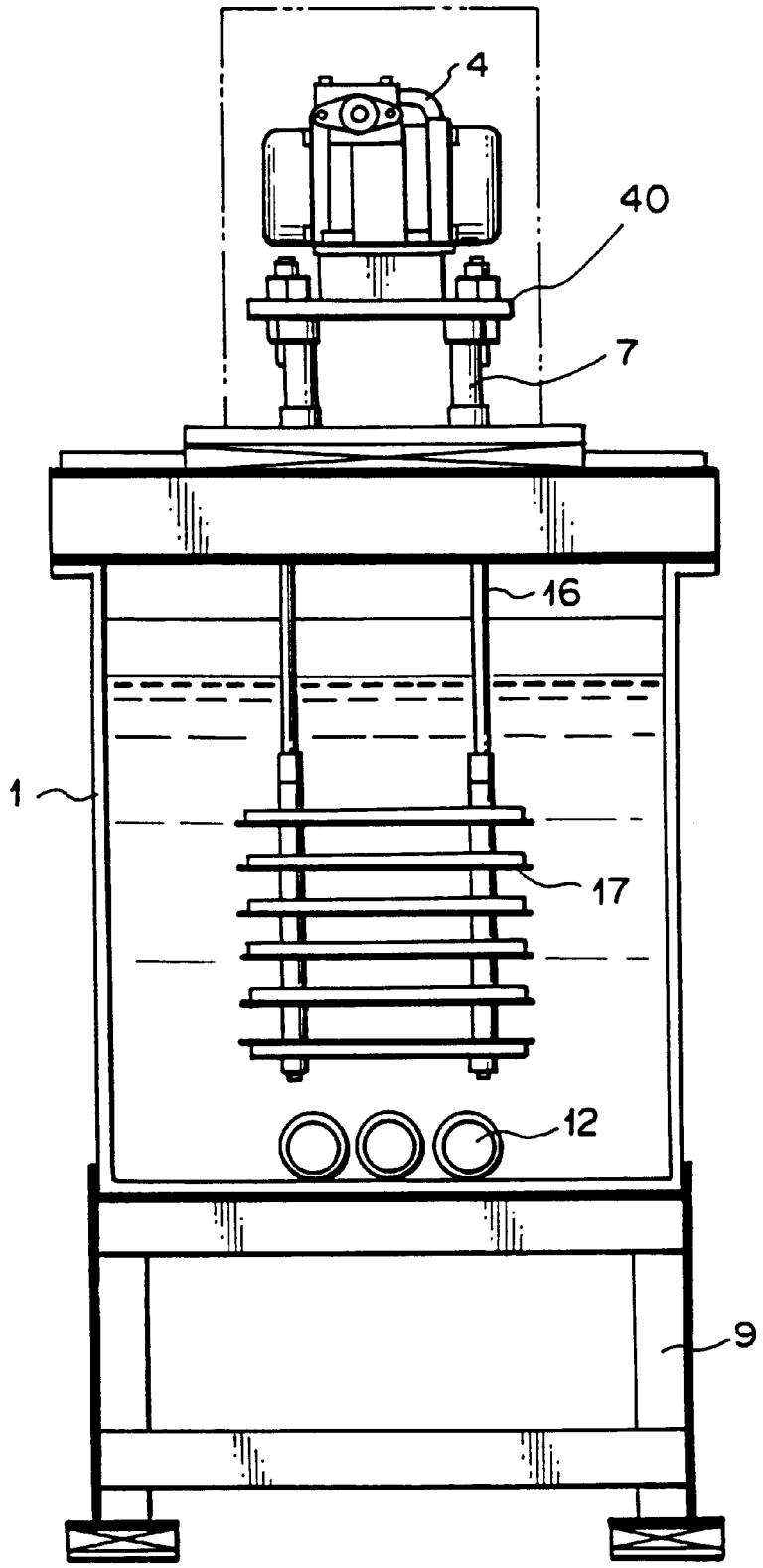
FIG. 2 is a cross-sectional view showing the apparatus of FIG. 1.
Figure 3:
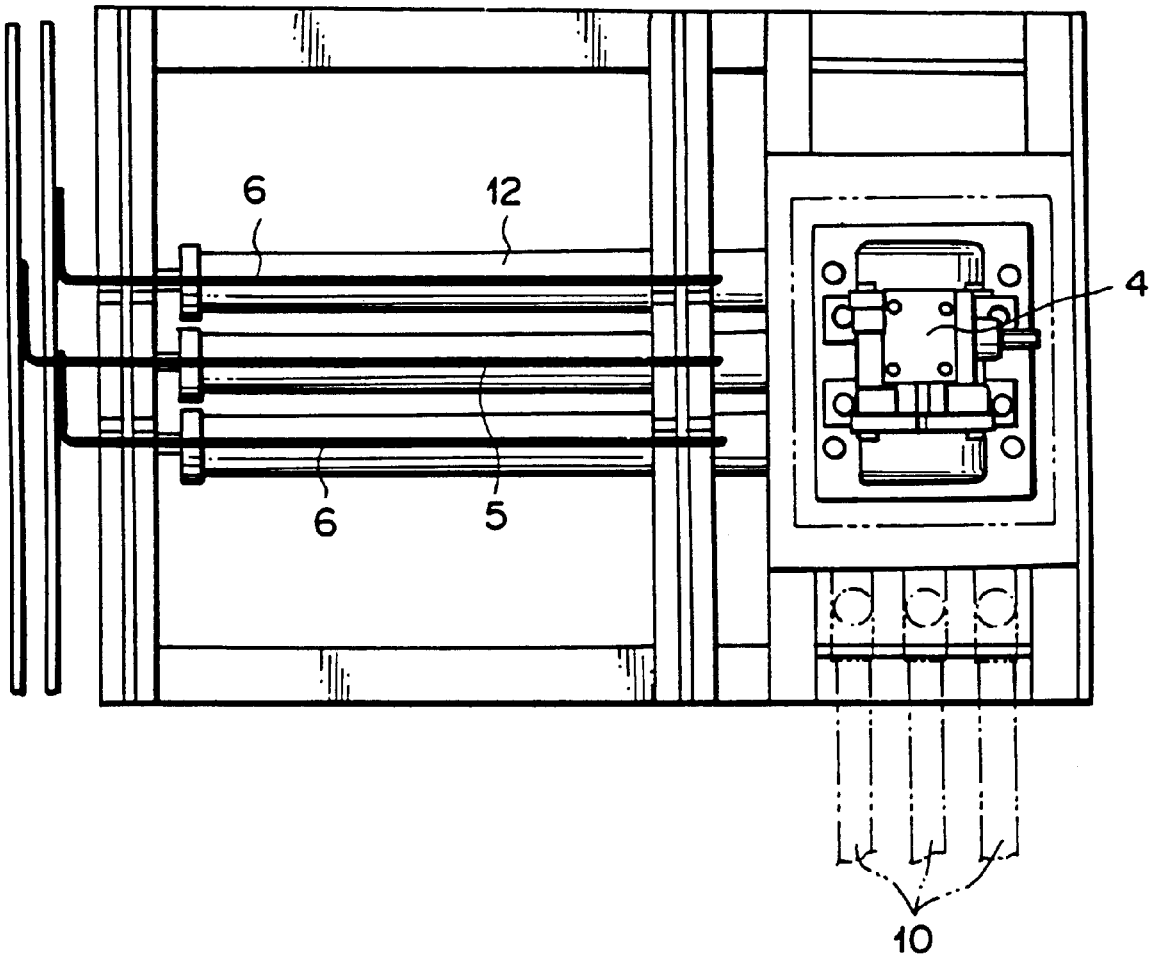
FIG. 3 is a plan view showing the apparatus of FIG. 1.

FIGS. 1 to 3 show an embodiment of the anodizing apparatus according to the present invention in which the apparatuses (A) and (B) are provided.

In FIGS. 1 to 3, the aeration apparatus (B) includes three diffusing pipes 12 disposed on the bottom plate of the treatment tank 1, and compressed air inlet ports 10 through which compressed air is fed to the diffusing pipes 12. Reference numeral 4 denotes a vibration motor, 16 a vibrating bar, 17 a vibration vane. These are parts of the vibrationally fluidly stirring apparatus (A).

Reference numeral 5 denotes an anode bar which serves as a suspending member for a treatment target or a metal body (not shown). Reference numeral 6 denotes a cathode bar which serves as a suspending member for a cathode (not shown). Reference numeral 9 denotes a base member on which the treatment tank 1 is disposed.

The diffusing pipe 12, treatment tank 1, compressed air inlet ports 10, vibration motor 4, vibrating bar 16, vibration vane 17, anode bar 5, cathode bar 6 and base member 9 are substantially the same as those of the embodiments set forth hereunder.

Figure 4:
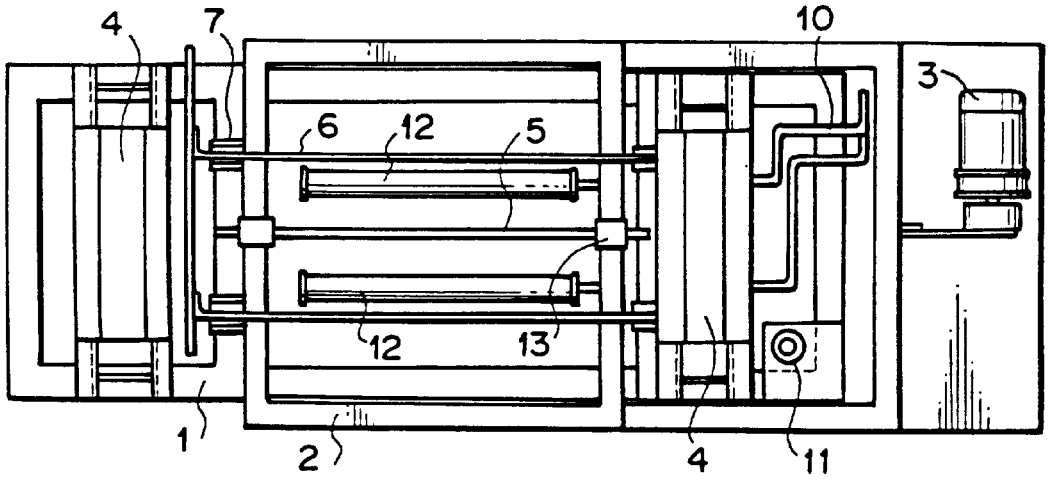
FIG. 4 is a plan view showing another embodiment of an apparatus used in the present invention.
Figure 5:
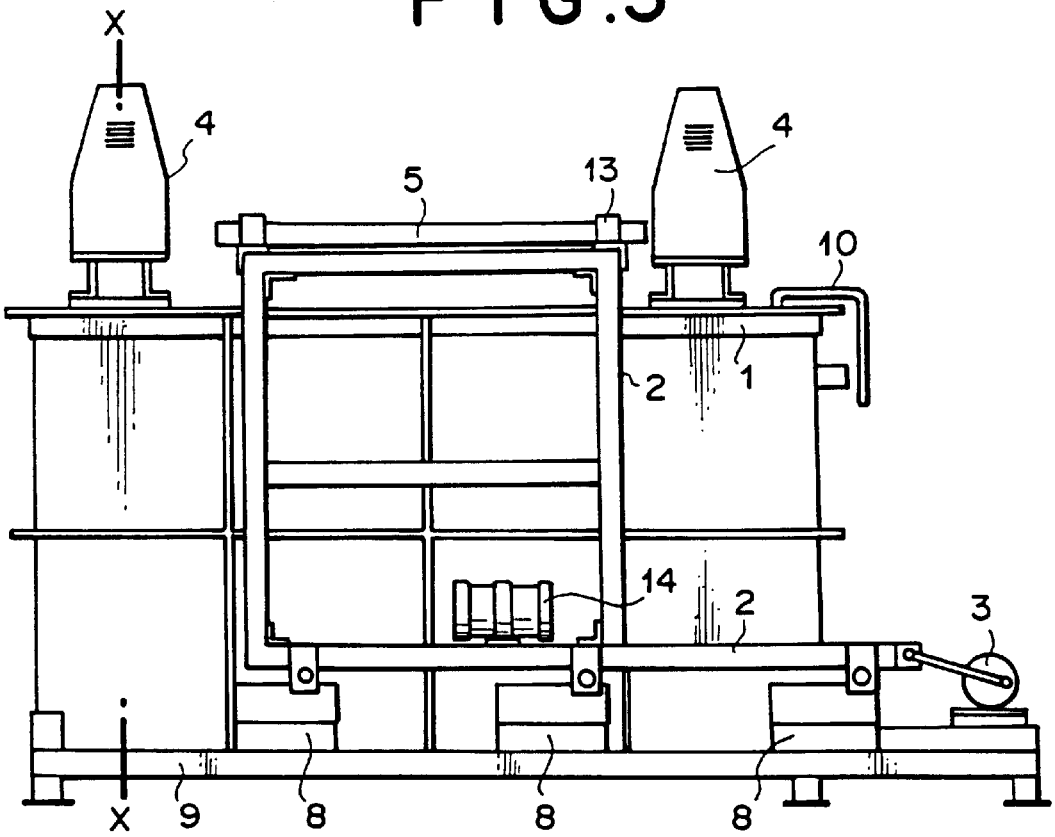
FIG. 5 is a side view showing the apparatus of FIG. 4.
Figure 6:
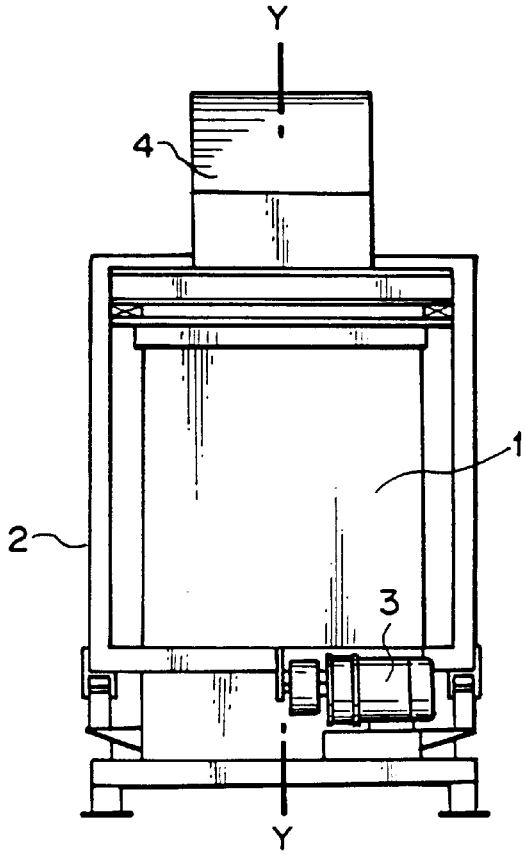
FIG. 6 is a front view showing the apparatus of FIG. 4.
Figure 7:
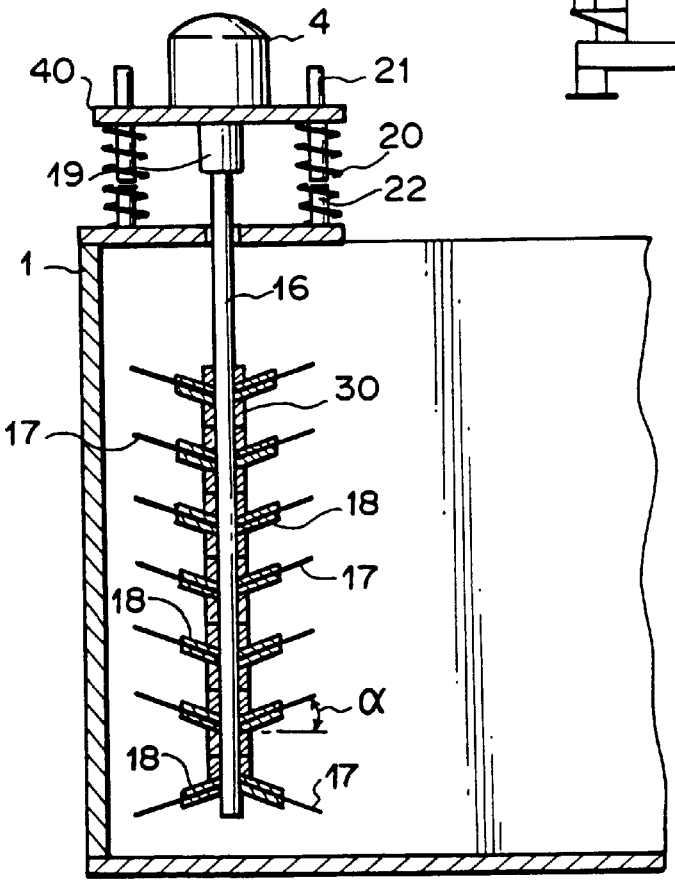
FIG. 7 is a cross-sectional view taken along line Y—Y of FIG. 6.
Figure 8:
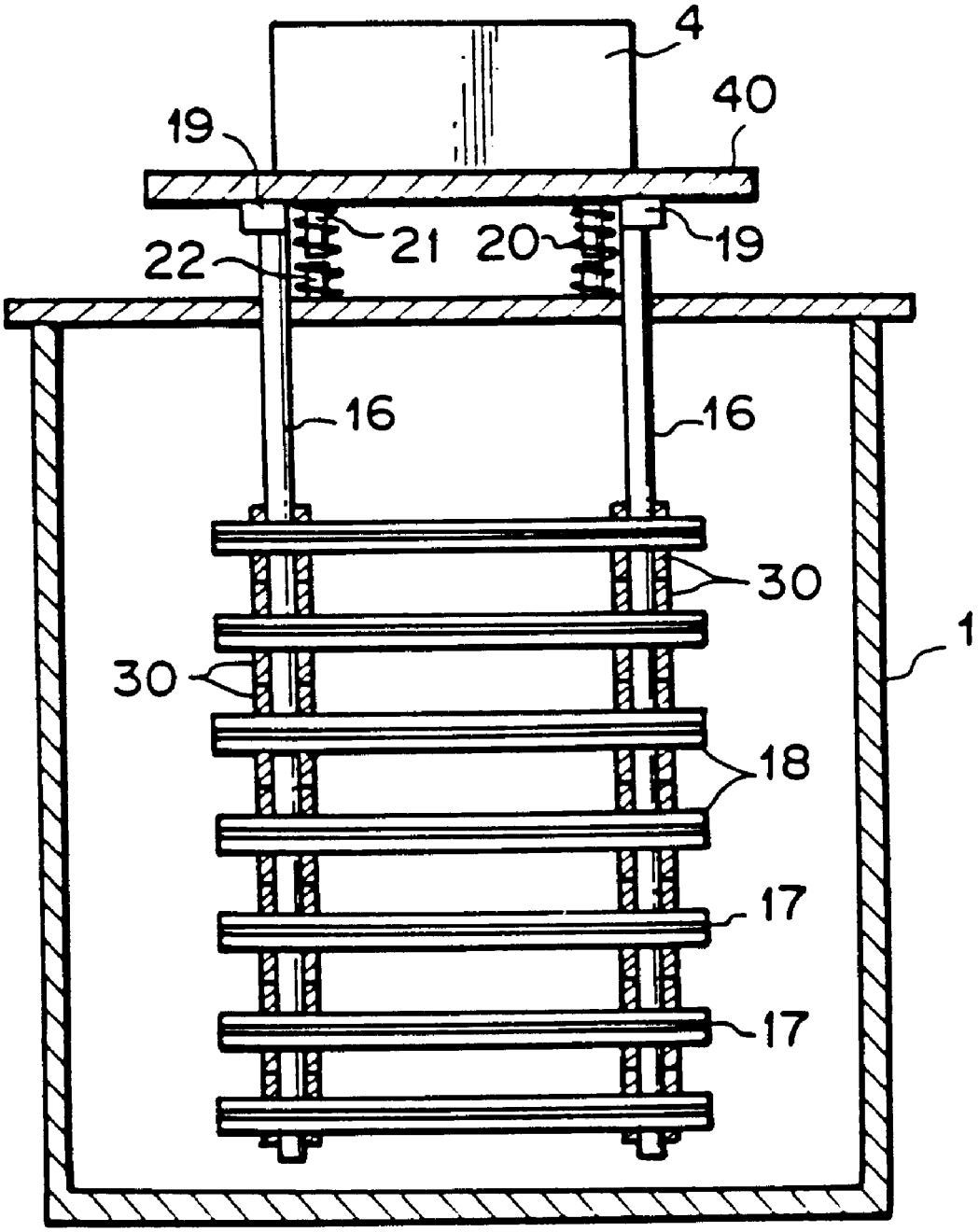
FIG. 8 is a cross-sectional view taken along line X—X of FIG. 5.

In FIGS. 4 to 6 showing an another embodiment, the apparatuses (A), (B), (C) and (D) are provided. The vibrationally fluidly stirring apparatus containing vibration motor 4 shown in FIGS. 4 to 6 is shown in FIGS. 7 and 8.

In FIGS. 4 to 6, the aeration apparatus (B) includes two diffusing pipes 12 disposed on the bottom plate of the treatment tank 1, and compressed air inlet ports 10 through which compressed air is fed to the diffusing pipes 12.

In FIGS. 4 to 6, the swing apparatus (D) is provided with swing motor 3, a swing support frame 2 which is swung by the motion of the swing motor 3 and suspending member 5 which also serves as anode bar and is fixed to the swing support frame 2 by anode bar support 13. An object to be subjected to the anodizing treatment (hereinafter referred to as a treatment target or metal body) is electrically connected and physically fixed to the anode bar 5. The swing motion is made slowly at an amplitude of 10 to 100 mm, preferably 20 to 60 mm and at a frequency of 10 to 30 times per minute. The swing support frame 2 is swung in the right-and-left direction in FIGS. 4 and 5 so that the bottom portion thereof moves on guide members 8 attached to the base member 9 to which the swinging motor 3 is attached.

In order to apply vibration to the swing support frame 2, the vibration motor 14 is fixed to an appropriate position on the swing support frame 2. The oscillation of the vibration motor 14 vibrates the swing support frame 2, and the vibrational motion of the swing support frame 2 is transmitted to the metal body such as aluminum body, aluminum alloy body, or the like. With these members the vibration applying apparatus (C) is formed. The vibration motor 14 generates vibration of 10 to 60 Hz, preferably 20 to 35 Hz by an inverter, and the swing support frame 2 is vibrated at an amplitude of 0.5 to 1.0 mm and at a frequency of 100 to 300 times per minute.

In FIG.4, reference numerals 6, 7, 11 denote a cathode, cathode holder and heater, respectively.

An embodiment of the vibrationally fluidly stirring apparatus (A) for the treating bath is shown in FIGS. 7 and 8. However, the vibrationally fluidly stirring apparatus is not limited to this embodiment. For example, there may be used vibrationally fludly stirring apparatuses as disclosed in Japanese Patent Laid-open No. Hei-6-304461, Japanese Patent Laid-open No. Hei-6-312124 (corresponding to U.S. Pat. No. 5,375,926), Japanese Patent Laid-open No. Hei-6-330395, Japanese Patent Laid-open No. Hei-8-173785, Japanese Patent Laid-open No. Hei-9-40482 and Japanese Patent Publication No. Hei-6-71544, which were proposed by the inventor of this application.

In FIGS. 7 and 8, basic vibration member 40 on which vibration motor 4 is secured is loaded on the tank 1 via a plurality of coiled springs 20. Inside of each spring 20, there is positioned lower supporting rod 22 secured to the treatment tank 1 vertically and upper supporting rod 21 secured to the basic vibration member 40 vertically in alignment with the lower supporting rod 22. The upper end of the lower supporting rod 22 is separated by a certain distance from the lower end of the upper supporting rod 21.

Figure 9:
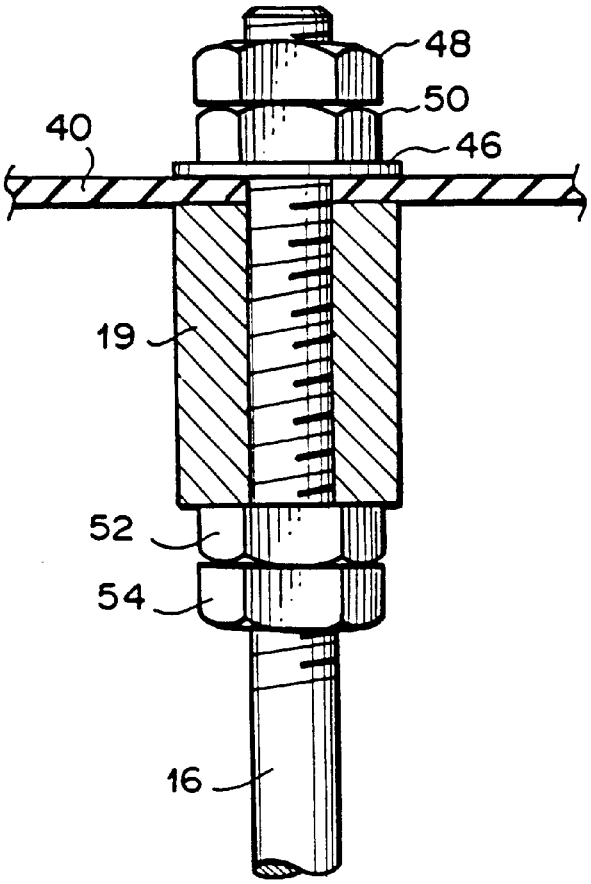
FIG. 9 shows an enlarged cross-section of a portion of a vibrating bar.

FIG. 9 shows an enlarged cross-section of a portion of each vibrating bar 16 attached to the basic vibration member 40. A vibration stress dispersing means 19 formed of a rubber ring is provided around the vibrating bar 16 at the connection portion between the basic vibration member 40 of the vibration generating apparatus and the vibrating bar 16. Reference numeral 46 denotes a washer, 48, 50, 52 and 54 each a nut. The length of the rubber ring 19 is set to be longer than the diameter of the vibrating bar 16, typically to three to eight times of the diameter of the vibrating bar, and the outer diameter (size) thereof is set to 1.3 to 3.0 times of the diameter of the vibrating bar, preferably to about 1.5 to 2.5 times. From another viewpoint, when the vibrating bar 16 is a round bar having a diameter of 10 to 16 mm, the thickness of the rubber ring 19 is preferably set to 10 to 15 mm. When the diameter of the vibrating bar (round bar) is set to 20 to 25 mm, the thickness of the rubber ring is preferably set to 20 to 30 mm. In the case where no rubber ring is used, there is a problem that the vibration stress is concentrated around the connection portion between the basic vibration member 40 and the vibrating bar 16, and thus the vibrating bar is liable to be broken. However, in this case, the above problem can be completely solved by fixedly inserting the rubber ring.

In FIGS. 7 and 8, on each vibrating bar 16, spacer 30 is positioned between the neighboring vibration vanes 17 so that the vanes each held by a pair of vibration vane fixing members 18 are positioned at a certain interval.

The vibration vane 17 is preferably formed of thin metal, elastic synthetic resin, rubber or the like, and the thickness thereof may be set so that at least the tip portion of the vane plate shows a flutter phenomenon (as if it is corrugated) by the vertical oscillation of the vibration motor 4, whereby the oscillation is applied to the system or the treatment bath to induce fluidity or flow. As the material of the metal vibration vane plate may be used titanium, aluminum, copper, steel, stainless steel, or alloy thereof. As the synthetic resin may be used polycarbonate, vinyl-chloride-based resin, polypropylene or the like. The thickness is not limited to a specific value, however, in order to transmit the oscillation energy and enhance the effect of the vibration, it is preferably set to 0.2 to 2 mm for metal, and 0.5 to 10 mm for plastics. If the thickness is excessively large, the vibrationally fluidly stirring effect is reduced.

The vibration vane may be secured in one stage or in multistage to the vibration bar. A plurality of vibration vanes may be used in accordance with the depth of the treatment bath. In the case where the number of stages is increased and the load on the vibration motor is excessively increased, the vibrational amplitude is reduced and the vibration motor becomes heated.

Further, all the vibration vanes may be secured perpendicularly to the vibration bar or shaft. However, it is preferable that they are secured to be inclined at 5 to 30 degrees, preferably 10 to 20 degrees in (+) or (−) direction when the perpendicular direction to the vibration shaft is assumed to zero degree (see FIGS. 7 and 10).

The vibration vane fixing member 18 and the vibration vane 17 may be integrally inclined and/or bent when viewed from the side of the vibration shaft. Even when they are bent, they are preferably inclined at 5 to 30 degrees, preferably 10 to 20 degrees as a whole.

Figure 10:
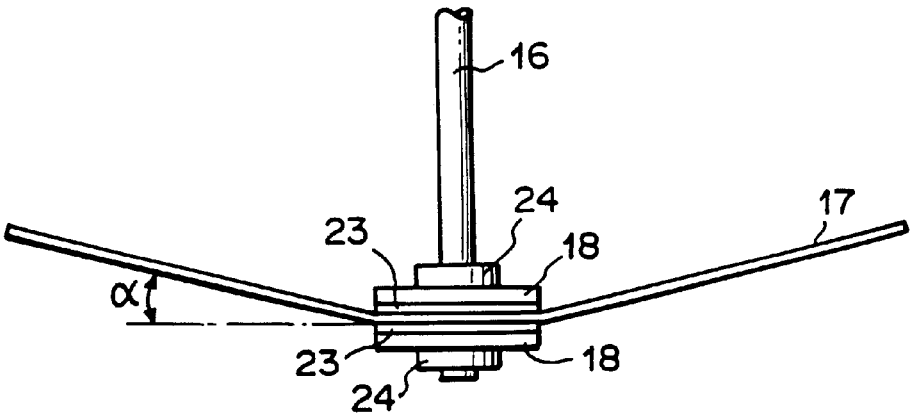
FIG. 10 is an enlarged cross-sectional view showing a manner of fixing vibration vanes to a vibration bar.

The vibration vanes 17 are fixed to the vibration bar 16 while pinched from the upper and lower sides by the vibration vane fixing member 18, thereby forming vibration vane portions. Specifically, threaded holes may be formed in the vibration bar 16 to fasten the vanes 17 to the vibration bar by screws. However, it is preferable that the vibration vane 17 is suppressed by the vibration vane fixing members 18 assistantly so that it is pinched from the upper and lower sides by the vibration vane fixing members 18 as shown in FIG. 10 and then the vibration vane fixing members 18 are fastened by nuts 24 to fix the vibration vane 17 to the vibration bar 16.

When the vibration vanes are inclined and/or bent, lower one or two of the many vibration vanes may be inclined and/or bent downwardly while the other vibration vanes are inclined and/or bent upwardly. With this structure, the stirring of the bottom portion of the treatment bath can be sufficiently preformed, and occurrence of traps at the bottom portion can be prevented.

When it is required not to stir only at the bottom portion of the treatment bath, the vibration vanes which are downwardly bent may be removed. This is effectively applied to such a case where undesired components such as deposits, etc. are reserved at the lower portion and removed from the lower portion without any dispersion of these undesired components in the tank.

In order to prevent discharge of the generated gas from the the treatment bath, it is preferable to incline or bend all the the vibration vanes downwardly.

Figure 11:
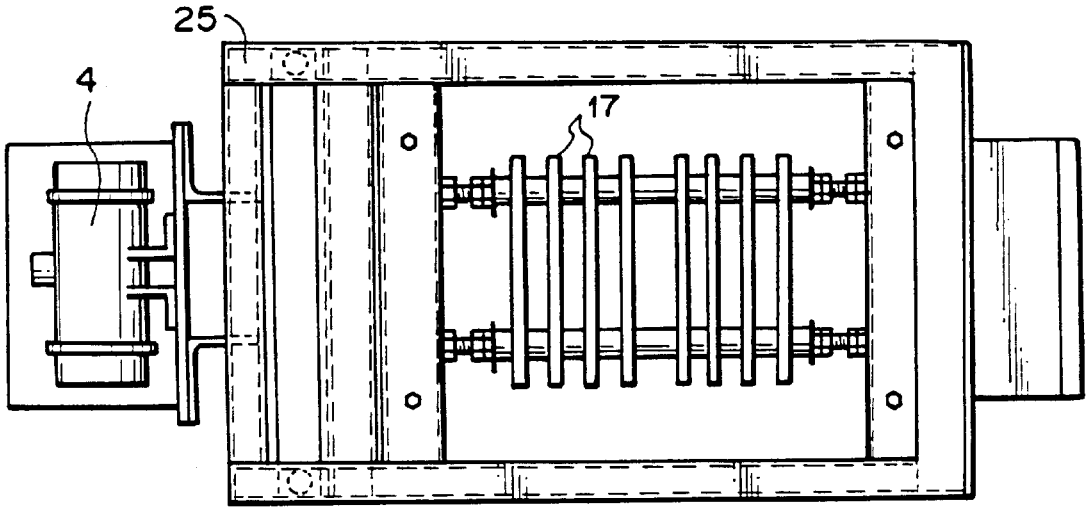
FIG. 11 is a plan view showing still another embodiment of a lateral vibration stirring apparatus.
Figure 12:
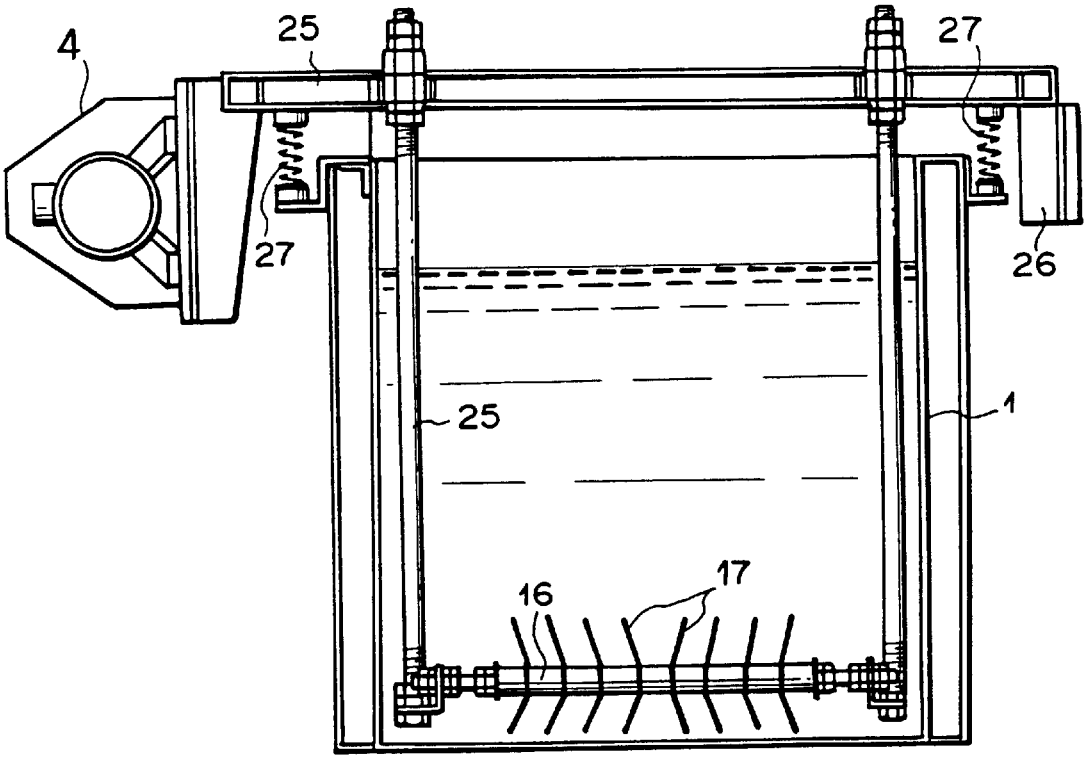
FIG. 12 is a cross-sectional view of FIG. 11.
Figure 13:
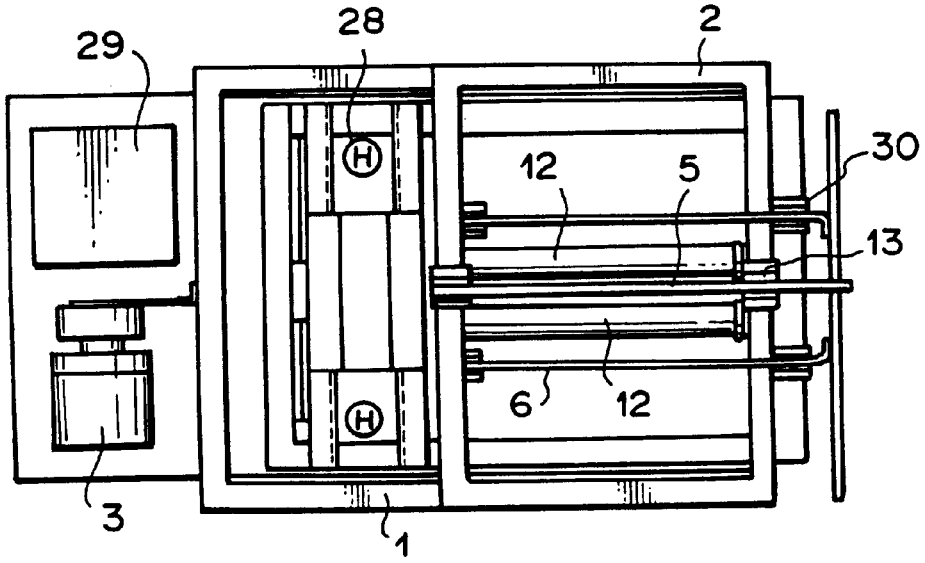
FIG. 13 is a plan view showing further embodiment of the apparatus used in the present invention.
Figure 14:
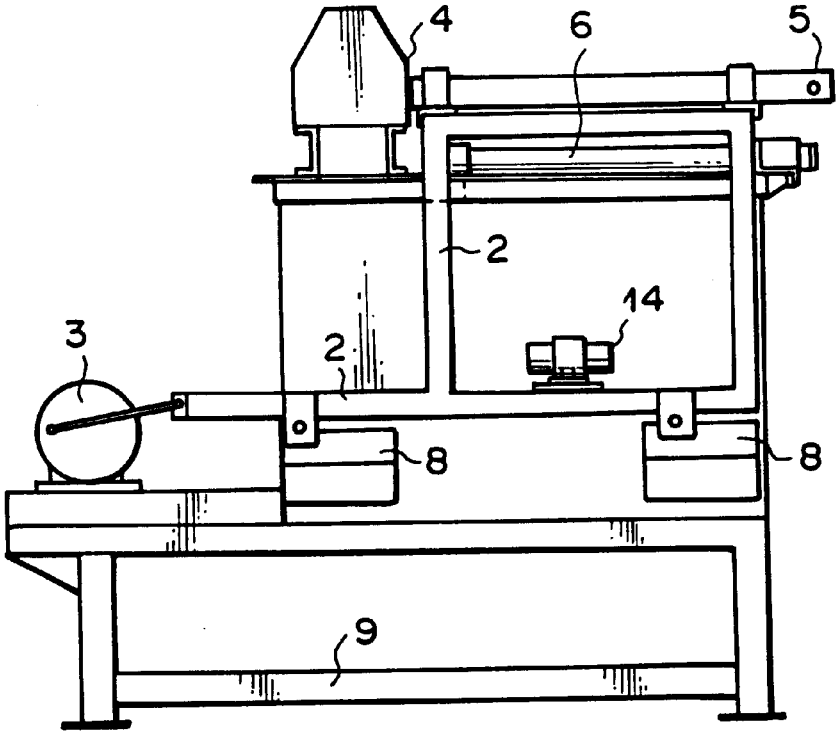
FIG. 14 is a side view of the apparatus of FIG. 13.
Figure 15:
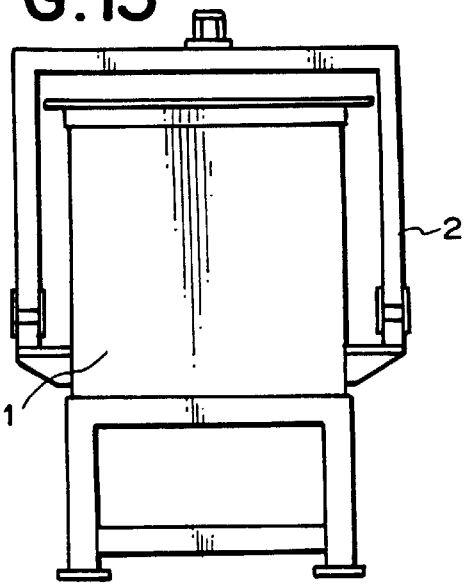
FIG. 15 is a front view of the apparatus of FIG. 13.

The vibrationally stirring apparatus may be provided to one end of the treatment tank as shown in FIGS. 1 to 3 and in FIGS. 13 to 15, wherein reference numerals 28, 29 and 30 are heater, air compressor for aeration and cathode holder, respectively. However, it may be provided to both ends of the treatment tank as shown in FIGS. 4 to 10 to cope with a large-scale tank. Further, any vibrationally fluidly stirring apparatus shown in the above-mentioned figures is of such a type that the vibration vanes are vibrated in the vertical direction. However, it may be designed so that the vibrational direction is set to the horizontal direction and the vibration vanes 17 are disposed at the bottom portion of the treatment tank 1 as disclosed in the above-mentioned Japanese Patent Laid-open No. Hei-6-304461, or as shown in FIGS. 11 and 12, wherein reference numeral 25 denotes an oscillation transmitting frame on which the vibration motor 4 is mounted, and reference numeral 27 denotes a support spring. In this case, in order to balance the left-side weight including the vibration motor 4 and the right-side weight, balancer 26 is preferably disposed as shown in FIG. 12.

As shown in FIG. 1, the vibration vane 17 may be attached to the vibration bar 16 with a positional deviation toward the center of the treatment tank 1 to effectively increase the strength of the vibrationally fluidly stirring in the treatment bath.

The vibration bar may be used while directly linked to the vibration motor. However, as disclosed in the above-mentioned Japanese Patent Laid-open No. Hei-6-304461 and Japanese Patent Laid-open No. Hei-6-330395, it may be used in such a mode that the vibration of the vibration motor is transmitted to the vibration bar 16 through the vibration frame 25 as shown in FIGS. 11 and 12.

Further, fluorine-based polymer films 23 are preferably interposed between the vibration vane 17 and the vibration vane fixing member 18 as shown in FIG. 10 because damage rate of the vibration vanes can be greatly reduced. As the fluorine-based polymer may be used polytetrafluoroethylene (PTFE), tetrafluoroethylene/hexafluoropropylene copolymer (FEP), tetrafluoroethylene/perfluoroalkyl vinyl ether copolymer (PFA), polychlorotrifluoroethylene (PCTFE), polyvinylidene fluoride (PVDF), polyvinyl fluoride, ethylene/tetrafluoroethylene copolymer (ETFE), ethylene/chlorotrifluoroethylene copolymer, propylene/tetrafluoroethylene copolymer or the like. Fluorine-based rubber is preferably used.

Figure 16:
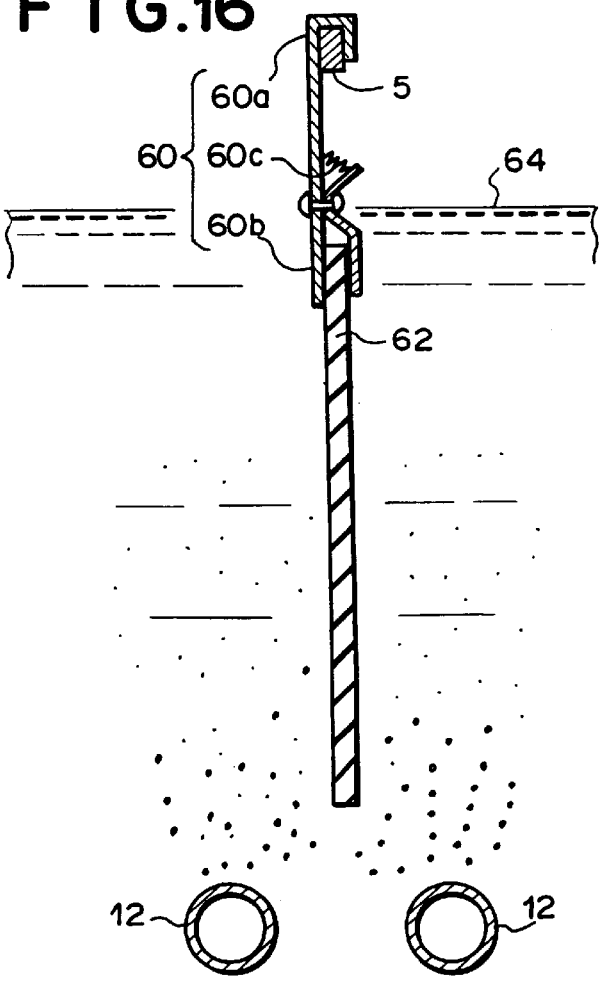
FIG. 16 shows a metal body suspended on anode bar.

As shown in FIG. 16, when the metal body 62 is treated in the treatment bath 64, the metal body 62 is clamped by a holder 60. The holder 60 comprises hook portion 60*a* suspended to the anode bar 5, clamp portion 60*b* holding the upper portion of the metal body 62 and compression spring 60*c* for generating clamp force. The uppermost portion of the metal body 62 is positioned in the treatment bath 64. Air bubbles are generated in the treatment bath 64 by the diffusing pipes 12. The metal body 62 is transported together with the holder 60 from a treatment tank to another treatment tank.

Figure 17:
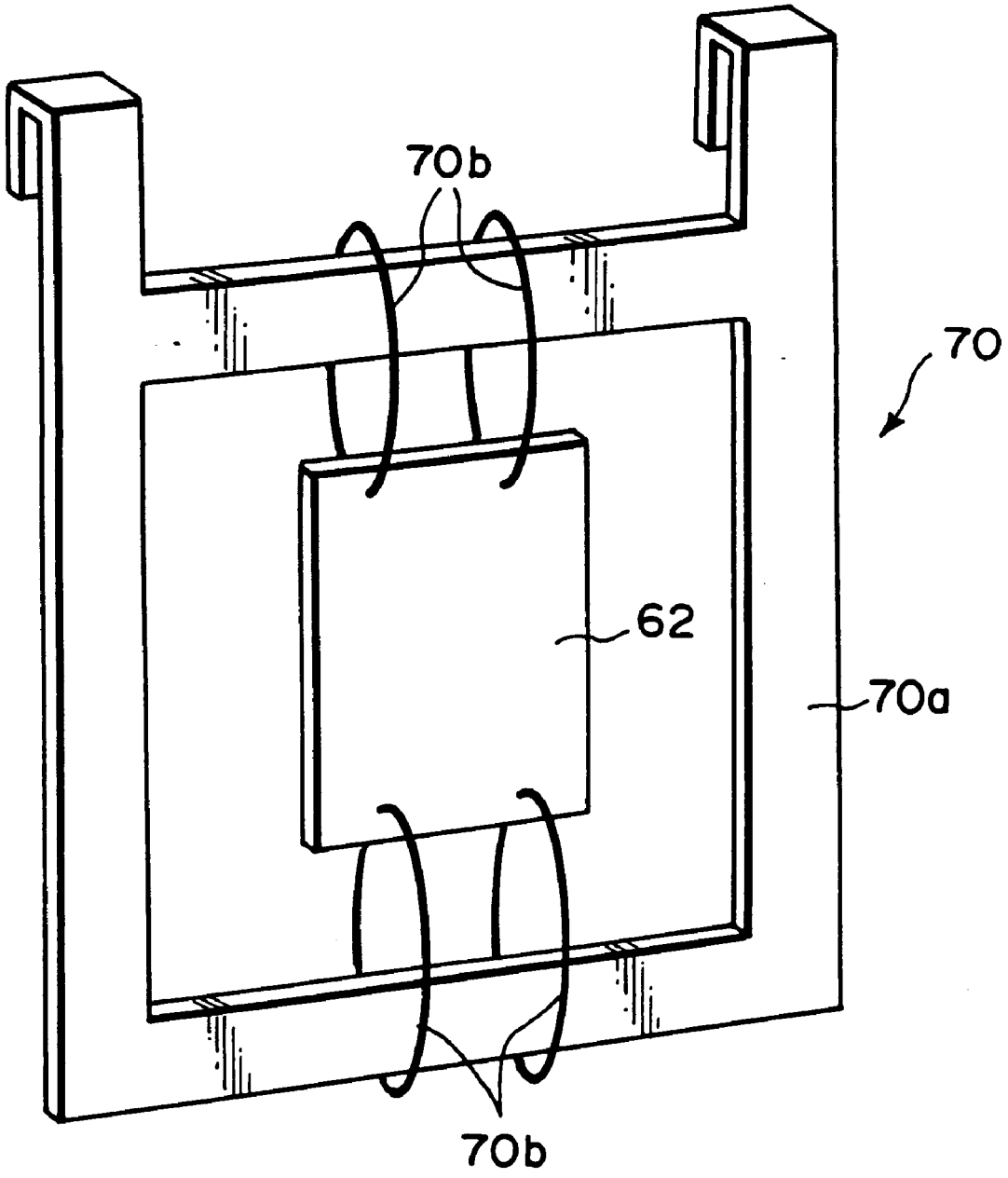
FIG. 17 shows a metal body held by holder.

When the metal body 62 is relatively light in weight or small in size, it is preferable to adopt another type of holder 70 shown in FIG.17, which comprises supporting frame 70*a* which is to be electrically and mechanically connected to the anode bar 5 and wire 70*b* for fixing the metal body 62 to the supporting frame 70*a*.

Figure 18:
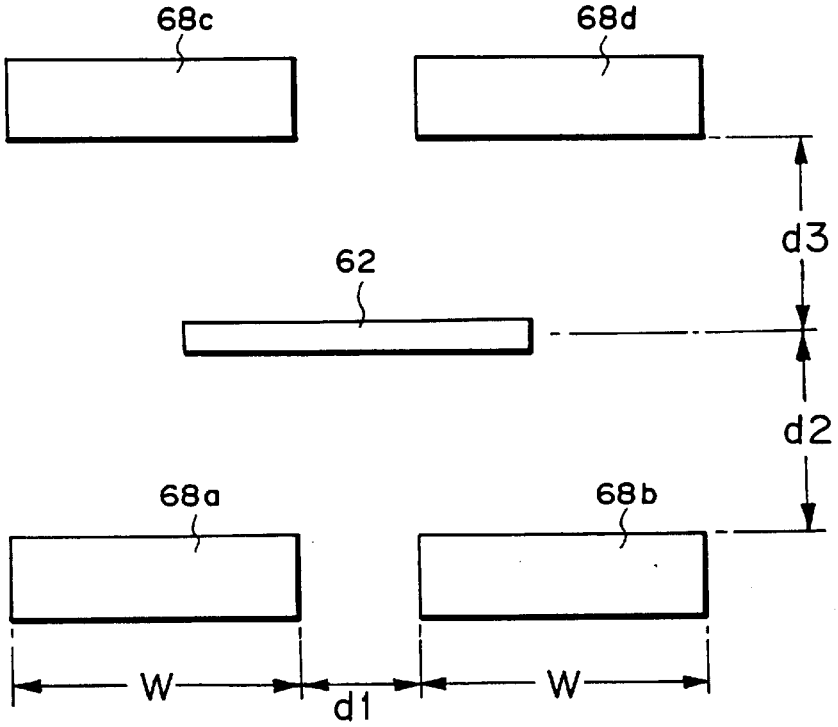
FIG. 18 is a plan view showing arrangement of anode and cathode.

FIG. 18 is a plan view showing an example of the arrangement of the anode and cathode in the treatment bath. Each of four cathodes 68*a* to 68*d* has the width of w. The cathodes 68*a*, 68*b* and cathodes 68*c*, 68*d* are electrically and mechanically connected to one and the other cathode bars 6 shown in FIG. 1, respectively, with the interval of d1. The anode or the metal body 62 is disposed at the central position of the four cathodes 68*a* to 68*d* with the interval of d2 and d3 (=d2).

Figure 19:
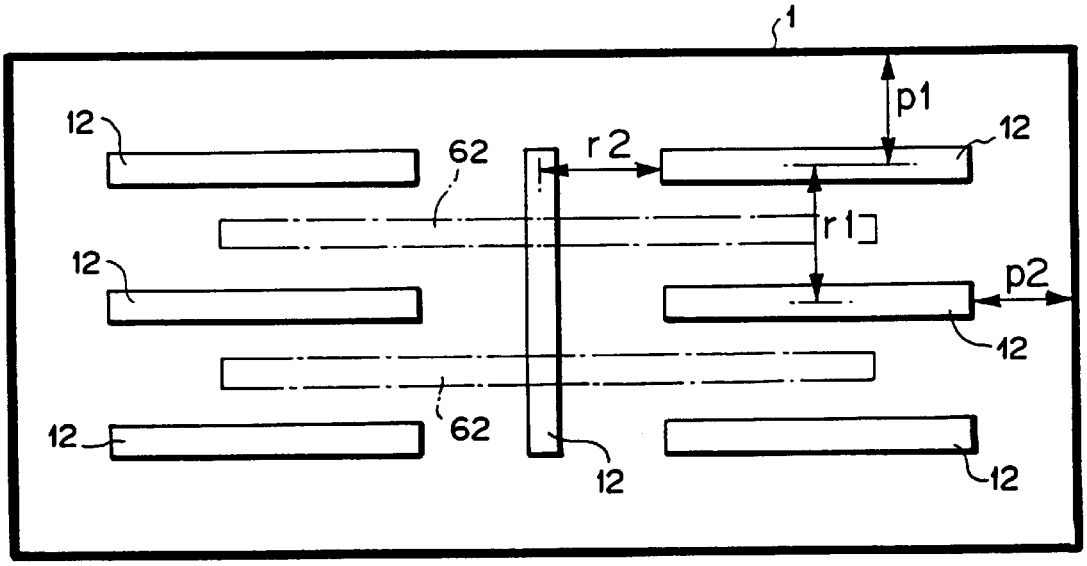
FIG. 19 is a plan view showing arrangement of diffusing pipe.

FIG. 19 is a plan view showing an example of the arrangement of the ceramic diffusing pipe in the treatment tank. This arrangement is preferable especially in the case that the metal body 62 is longer than the diffusing pipe 12. A plurality of the diffusing pipes 12 arranged with the intervals r1, r2 to each other are arranged in the treatment tank 1 with the intervals p1, p2. For uniform aeration in the treatment bath, the intervals r1, r2 are preferably 100 to 120 mm and the intervals p1, p2 are preferably 50 mm or more.

Figure 20:
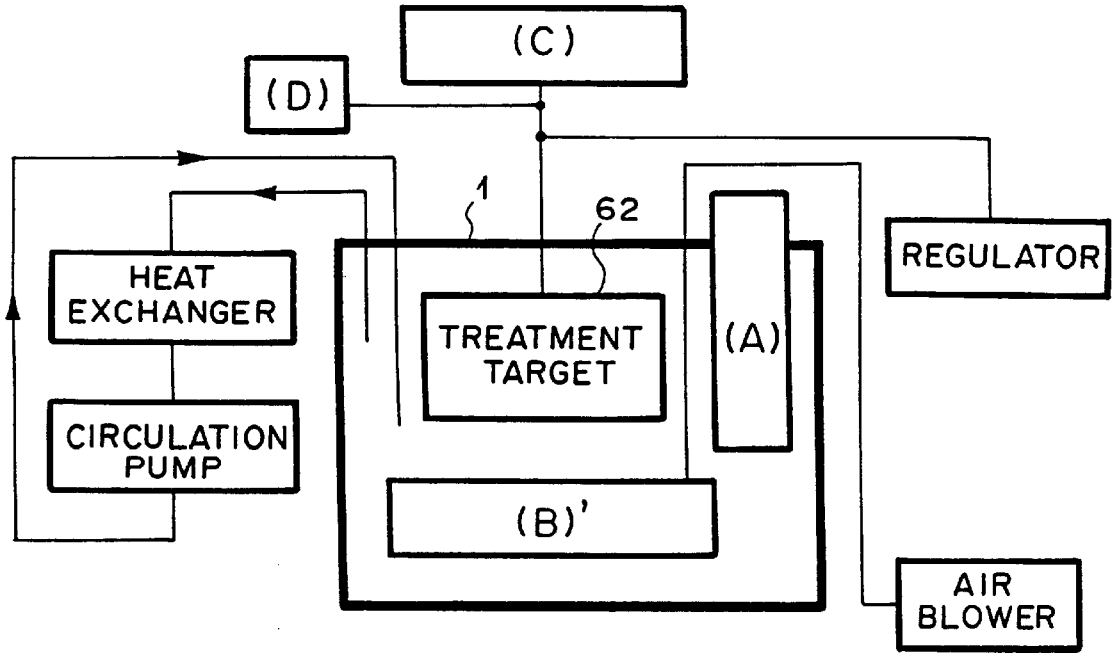
FIG. 20 is a block diagram of anodizing apparatus of the present invention.

In block diagram of FIG. 20, (A), (C) and (D) are the above-mentioned vibrationally fluidly stirring apparatus, the vibration applying apparatus and swing apparatus, and (B)' is the above-mentioned diffusing pipe. The regulator charges an appropriate voltage necessary for the anodizing treatment process between the treatment target or anode and the cathode. The treatment bath in the treatment tank 1 is circulated by a pump throgh a heat exchanger. The air blower supplies compressed air to the diffusing pipe (B)'. The aeration apparatus (B) comprises the diffusing pipe (B)' and the air blower.

The present invention may be performed without operating at least one of the apparatuses (C) and (D). Alternatively, at least one of the apparatuses (C) and (D) may be omitted as the above-mentioned embodiment shown in FIGS. 1 to 3.

Figure 21:
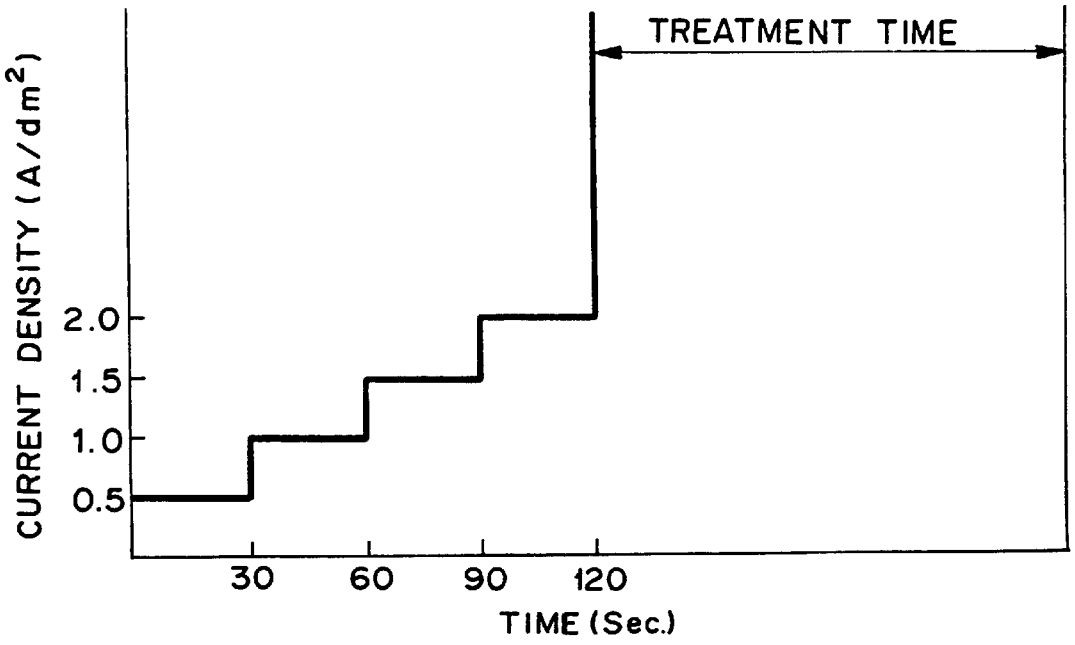
FIG. 21 is a diagram of initial current density in anodizing process.

FIG. 21 is a diagram of an example of the initial current density in the anodizing process under the mild condition. The current density is set so as to vary with stepwise increment.

Figure 22:
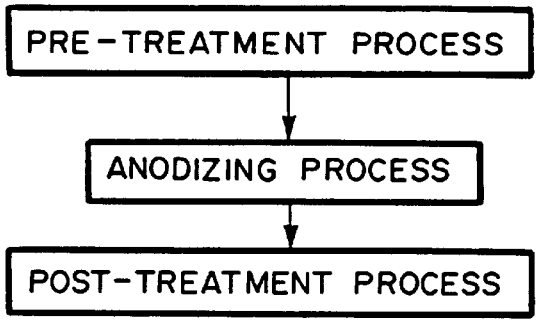
FIG. 22 is a flow diagram of continuous treatment system.

According to the present invention, a continuous and automated treatment system or line shown in FIG. 22 can be realized, in which the metal body or treatment target is transported via treatment tanks for performing the steps of the above-mentioned pre-treatment process, the anodizing process and the post-treatment process.

In the treatment tanks for the pre-treatment process or post-treatment processes, it is preferable to use the apparatus (A), and more prefarable to use the apparatuses (A) and (B) in combination. It is also preferable to use the combinations of the apparatuses (A)+(B)+(C), the apparatuses (A)+(B)+(D), or the apparatuses (A)+(B)+(C)+(D).

It is preferable to use these apparatus(es) in at least one of the degreasing step, the polishing step of electrolytic polishing or chemical polishing, and the hot water sealing step to enhance the efficiency of the step.

For example, when the vibrationally fluidly stirring apparatus (A) is operated in the electrolytic polishing process, the following composition of the treatment bath:

| | |
|---|---|
| $H_3PO_4$ (89% aqueous solution) | 300 g/liter |
| $H_2PO_4$ | 200 g/liter |
| Glycerine | 10 g/liter |

which is relatively low in concentration can be used, and the relatively low treatment temperature of 50 to 60° C. and the relatively short treatment time of 7 to 11 minutes can be used to improve the cost performance. In addition, the anodic oxide film obtained has a good external appearance and good gloss.

On the other hand, if the vibrationally fluidly stirring apparatus (A) is not operated in the electrolytic polishing process, the relatively long treatment time of 10 to 15 minutes is necessary at the current density of 10 to 16 A/dm$^2$, voltage of 5 to 20 V and the treatment temperature of 90 to 100° C. when the following composition of the treatment bath:

| | |
|---|---|
| $H_3PO_4$ (89% aqueous solution) | 600 g/liter |
| $H_2PO_4$ | 400 g/liter |
| Glycerine | 10 g/liter |

which is relatively high in concentration is used.

Also in case of the chemical polishing process, the treatment temperature can be significantly lowered and the anodic oxide film obtained has a good external appearance and good gloss by operating the vibrationally fluidly stirring apparatus (A).

Examples according to the present invention and Comparative Examples will be described below, however, the present invention is not limited to the following Examples.

In the following Examples, the apparatus of FIG. 20 is used. However, in certain Examples, the apparatuses (C) and/or (D) are not operated or omitted as shown in FIGS. 1 to 3.

EXAMPLE 1

The apparatus of type of FIGS. 1 to 3 was used. The size, capacity, etc. of each component apparatus were as follows:

(1) Anodizing Treatment Tank

The tank made of heat-resistant polyvinyl chloride and having width of 500 mm, length of 750 mm and height of 550 mm was used.

(2) Vibrationally Fluidly Stirring Apparatus

SUPERVIBRATING α AGITATOR Type 3, manufactured by JAPAN TECHNO CO., LTD., was used.

Vibration motor: URAS VIBRATOR KEE 3.5-2B, available from YASKAWA & CO., LTD., 250 W×200 V×3-phase, controlled by inverter (0.4 kW)

Vibration vane: effective area of 300×100 mm, thickness of 0.5 mm (five vibration vanes were used), α=15 degrees (the lowermost vane were inclined downwardly and the other vanes were inclined upwardly)

Amplitude of vibration vane: 1.5 mm (3) Diffusing Pipe

MICRO AERATOR BM-100 made of ceramics, manufactured by JAPAN TECHNO CO., LTD., was used.

Inner diameter: 50 mm

Outer diameter: 75 mm

Length: 450 mm

Porosity: 33 to 38%

Pore opening size: 50 to 60 μm

Bulk specific gravity: 2.2 to 2.5

(4) Air Blower for Diffusing Pipe

Rotary air pump of 150 W was used.

Air blowing rate: 120 liter/min (5) Anodizing Treatment Bath

| | |
|---|---|
| Volume: | 160 liter |
| Composition: | |
| $H_2SO_4$ | 200 g/liter |
| Aluminum | 4 g/liter |

(6) Cathode

Four aluminum plates each having width of 60 mm, length of 500 mm and thickness of 20 mm were used.

(7) Treatment Target (Metal Body: Anode)

Aluminum plate made of A1100P (JIS H 400) having width of 100 mm, length of 100 mm and thickness of 1.5 mm was used.

Si+Fe=1.0% or less

Cu=0.05–0.20%

Mn=0.05% or less

Zn=0.10% or less

Al=99.0% or more (8) Target Holder

Titanium supporting frame and aluminum wires for fixing the target to the supporting frame were used (See FIG. 17).

(9) Heat Exchanger for Cooling the Treatment Bath

COOL LINER, automatic, directly cooling type, rapid cooling apparatus, manufactured by SHOWA ENTETSU CO., LTD., was used.

4010Kcal/h, Motor 1.5 KW

(10) Circulation Pump for the Heat Exchanger

Magnet pump, IWAKI MD-100RM, was used.

Maximum circulation rate: 120 liter/min

Maximum head: 8.6 m

Output: 265 W, 1.27 A

(11) Regulator

Direct current source, HI-MINI MB7C-600-01, manufactured by CHUO SEISAKUSHO CO., LTD., was used.

Rated-output: 60V-100 A, 6.0 KW

Alternating current input: 200 V, 21.2 A, 7.34 KVA

(12) Interval Between Anode and Cathode (d2, d3 in FIG. 18) 100 mm

(13) Arrangement of Treatment Tanks

Degreasing tank→Water washing tank →Etching tank→Water washing tank→Desmutting tank→Water washing tank→Anodizing tank→Water washing tank→Sealing tank→Drying tank Etching treatment: bath of caustic soda 50 g/liter, treatment time of 5 minutes under room temperature Desmutting treatment: bath of 5% nitric acid solution, treatment time of 1 minute under room temperature Sealing treatment: bath of ion-exchanged boiled water, treatment time of 15 minutes under room temperature The anodizing treatment was performed during 8 minutes under the condition of frequency of the vibration motor of the apparatus (A) of 37 Hz to generate vibration of vibration vane at frequency of 600 times per minute, anode potential of 20V, current density shown in FIG. 21, and bath temperature of 20° C.

An anodic oxide film having thickness of 20 μm was formed on the surface of the treatment target. The oxide film had good denseness and good external appearence with gloss. The result is shown in Table 2.

Comparative Example 1

The anodizing process was performed in the same manner as Example 1 with the exception that the vibrationally fluidly stirring apparatus (A) was not operated. The treatment time necessary for forming the anodic oxide film having thickness of 20 μm, i.e. the same as Example 1, was 40 mimutes. The result is shown in Table 2.

TABLE 2

| | Example 1 | Comparative Example 1 |
|---|---|---|
| Current density | 10 A/dm$^2$ | 2 A/dm$^2$ |
| Treatment time | 8 min. | 40 min. |
| Thickness [*1] | 20 μm | 20 μm |
| External appearence | superior gloss | inferior gloss |
| Hardness (Hv) [*2] | 430 | 350 |
| Corrosion resistance [*3] | 100 h | 48 h |
| Dyeing properties [*4] | good | somewhat good |
| Wearing properties [*5] | 1200 | 800 |

[*1] Thickness of the oxide film was measured by eddy current measuring method based on JIS H8680-1979.

[*2] Hardness of the oxide film was measured by using the Vickers hardness (Hv) tester based on JIS H8682-1988.

[*3] Corrosion resistance was measured by CASS test (copper-accelerated acetic acid salt spray test) based on JIS H8681-1988, rating No. 9.

[*4] Dyeing properties was determined by using water-soluble dye (red) for use in food processing based on JIS H8685-1988.

[*5] Wearing properties was measured by surface wearing test with reciprocal movement based on JIS H8682-1988. Loading is 400 ± 10 gf (3.92 ± 0.09 N) for general anodic oxide film and 2000 ± 50 gf (19.6 ± 0.49 N) for hard anodic oxide film.

Evaluation

Current density in Example 1, 10 A/dm$^2$, is significantly higher than that in Comparative Example 1, 2 A/dm$^2$.

Accodingly, in Example 1, the anodizing rate is increased by about 5 times as compared with Comparative Example 1. The hardness, corrosion resistance, dyeing properties and wearing properties of the oxide film obtained in Example 1 are improved as compared with Comparative Example 1.

Substantially the same tendency were obtained for the oxide film having thickness of 10 μm or 15 μm.

EXAMPLE 2

The anodizing process was performed in the same manner as Example 1 with the exception that the treatment time was 5 minutes under the condition of output of the vibration motor of the apparatus (A) of 150 V, anode potential of 15 V, and bath temperature of 30° C. The result is shown in Table 3.

Comparative Examples 2-1 and 2-2

The anodizing processes were performed in the same manner as Example 2 with the exception that the vibrationally fluidly stirring apparatus (A) was not operated. In Comparative Example 2-2, the treatment time was set so as to form the oxide film having the same thickness as Example 2. The result is shown in Table 3.

TABLE 3

| | | Comparative Example | |
|---|---|---|---|
| | Example 2 | 2-1 | 2-2 |
| Current density | 15 A/dm$^2$ | 3 A/dm$^2$ | 3 A/dm$^2$ |
| Treatment time | 5 min. | 5 min. | 20 min. |
| Temperature | 30° C. | 30° C. | 30° C. |
| Thickness [*1] | 15 μm | 5 μm | 15 μm |
| External appearence | gloss | uneven | no gloss/ with crack |
| Hardness (Hv) [*2] | 350 | 330 | unmeasurable |
| Corrosion resistance [*6] | 48 h | 24 h | unmeasurable |

[*6] Corrosion resistance was measured by neutral salt spray test based on JIS K5400.

Evaluation

In Example 2, the anodizing rate is increased by about 4 times as compared with Comparative Example 2-2, and the oxide film has good gloss and is sufficient for practical use. On the other hand, according to Comparative Examples 2-1 and 2-2, the oxide film obtained with use of higher treatment bath temperature of 30° C. is insufficient for practical use.

EXAMPLE 3

The anodizing process was performed in the same manner as Example 1 with the exception that the aluminum plate of the treatment target was hard aluminum plate made of A5052P (JIS H400).

Si=0.25% or less

Fe=0.04% or less

Cu=0.01%

Mn=0.01% or less

Mg=2.2–2.8%

Cr=0.15–0.35%

Zn=0.1% or less

The result is shown in Table 4.

Comparative Example 3

The anodizing process was performed in the same manner as Example 3 with the exception that the vibrationally fluidly stirring apparatus (A) was not operated. The result is shown in Table 4.

TABLE 4

| | Example 3 | Comparative Example 3 |
|---|---|---|
| Current density | 15 A/dm$^2$ | 3.5 A/dm$^2$ |
| Treatment time | 8 min. | 30 min. |
| Thickness [*1] | 20 μm | 20 μm |
| External appearence | superior gloss | inferior gloss |
| Hardness (Hv) [*2] | 460 | 350 |
| Corrosion resistance [*6] | 150 h | 42 h |
| Dyeing properties [*4] | good | somewhat uneven |
| Wearing properties [*5] | 800 | 600 |

Evaluation

In Example 3 wherein hard anodic oxide film is formed, the anodizing rate is increased by about 4 times as compared with Comparative Example 3. The external appearence, hardness, corrosion resistance, dyeing properties and wearing properties of the oxide film obtained in Example 3 are improved as compared with Comparative Example 3.

EXAMPLE 4

Figure 23:
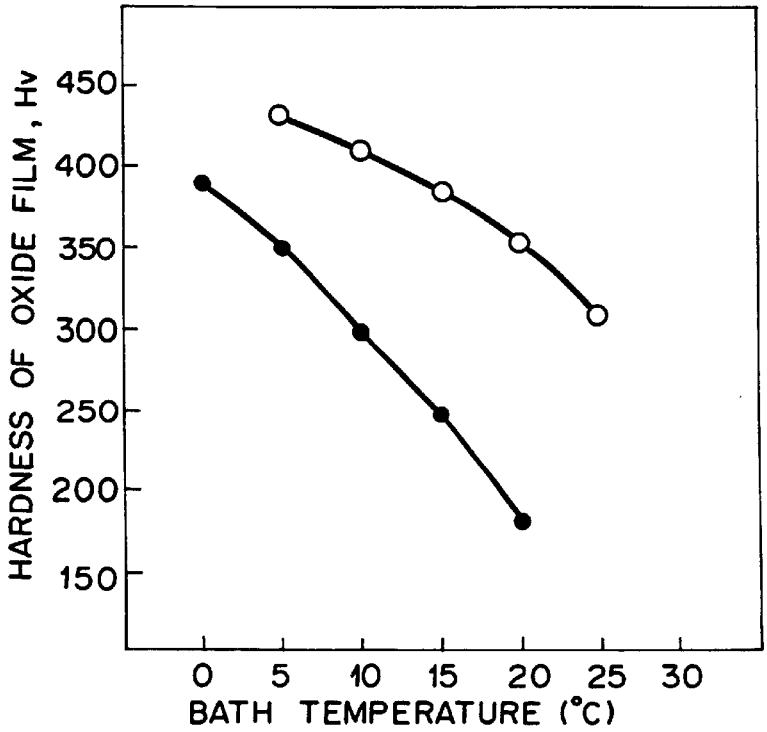
FIG. 23 shows a relationship between hardness (Hv) of oxide film obtained and treatment temperature used.

The anodizing processes were performed in the same manner as Example 1 with the exception that the aluminum plate was made of the above-mentioned A5052P (JIS H400), current density was 8 A/dm$^2$, and temperature of the treatment bath was varied as shown in FIG. 23 with symbols "○" to form the oxide films having thickness of 15 μm. Hardness (Hv) of the oxide films was measured. The result is shown in FIG. 23.

Comparative Example 4

The anodizing processes were performed in the same manner as Example 4 with the exception that the vibrationally fluidly stirring apparatus (A) was not operated, the current density was 1.5 A/dm$^2$, and the temperature of the treatment bath was varied as shown in FIG. 23 with symbols "•". Hardness (Hv) of the oxide films was measured. The result is shown in FIG. 23.

Evaluation

The oxide film obtained in Example 4 has the hardness (Hv) greater than that of Comparative Example 4 when the same temperature of the treatment bath is used. Therefore, when forming the oxide film having the same hardness, according to the present invention it is possible to employ the higher temperature than the conventional method, so that the present invention is significantly advantageous in energy consumption and treatment time.

EXAMPLE 5

The anodizing process was performed in the same manner as Example 1 with the exception that the treatment target was the aluminum body manufactured by casting and had size of about 150 mm×120 mm×40 mm with numerous depressions or dimples randomly formed on the surface and having the width of about 3 to 15 mm and the depth of about 15 to 20, and the the oxide film having the thickness of 15 μm was formed. The result is shown in Table 5.

Comparative Example 5

The anodizing process was performed in the same manner as Example 5 with the exception that the vibrationally fluidly stirring apparatus (A) was not operated. The result is shown in Table 5.

TABLE 5

| | Example 5 | Comparative Example 5 |
|---|---|---|
| Current density | 6 A/dm$^2$ | 1.5 A/dm$^2$ |
| Treatment time | 10 min. | 40 min. |
| Thickness | 15 $\mu$m | 15 $\mu$m |
| Temperature | 15° C. | 15° C. |
| External appearence | good | somewhat no-good |
| Quality of film: | | |
| Wall portion [*7] | good | no-good in some case |
| Bottom portion [*8] | good | insufficient thickness |

[*7] Wall portion: Film on the lateral wall surface of the depression
[*8] Bottom portion: Film on the bottom surface of the depression Evaluation The oxide film obtained in Example 5 is uniform in thickness also in the depression, whereas the oxide film obtained in Comparative Example 5 is ununiform in thickness, i.e. the film formed in the depression is significantly thinner than the film formed on the other portion, and has reduced gloss as compared with Example 5, although the treatment time of Comparative Example 5 is about 4 times of that of Example 5. Accordingly, the present invention is applicable to the case where the treatment target has depressions on the surface thereof, each depression having the width of 10 mm and the depth of 10 to 15 mm.

EXAMPLE 6

The anodizing process was performed in the same manner as Example 5 with the exception that the temperature of the treatment bath was 30° C., and the air blowing rate was 240 liter/min. The treatment time necessary for forming the oxide film having thickness of 15 $\mu$m was merely 5 minutes.

Such a higher rate of the anodizing process enables the continuously treating line through the pre-treatment, anodizing and the post-treatment with use of conveyer for continuously transporting the treatment target.

Comparative Example 6

The anodizing process was performed in the same manner as Example 6 with the exception that the vibrationally fluidly stirring apparatus (A) was not operated. The oxide film obtained was very uneven or ununiform and practically useless.

EXAMPLE 7-1

The apparatus of type of FIGS. 13 to 15 was used. The size, capacity, etc. of each component apparatus were as follows:

<Arrangement of Treatment Tanks>

Degreasing tank (○)→Water washing tank→Etching tank→Water washing tank→Desmutting tank (○)→Water washing tanks→Anodizing tank (◎)→Water washing tank→Sealing tank (○)→Drying tank The apparatuses (A) to (D) were used in comination in the above tank indicated by ◎, and the apparatus (A) was used in the above tanks indicated by ○. The treatment bath in the water washing tank was tap water of the room temperature.

<Treatment Target (Metal Body: Anode)>

Aluminum plate having size of 500 mm×200 mm×10 mm was used.

<Cathode>

Eight aluminum plates each having size of 500 mm×60 mm×20 mm were used.

The treatment target and cathode were arranged in the analogous manner to the case shown in FIG. 18. One set of four cathodes were disposed in series at one side of the treatment target with the interval d2 of 100 mm, the other set of four cathodes were disposed in series at the other side of the treatment target with the interval d3 of 100 mm, and the interval d1 was 15 mm.

<Anodizing Treatment Tank>

The tank having width of 500 mm, length of 750 mm and height of 550 mm was used.

<Vibrationally Fluidly Stirring Apparatus>

Vibration motor: URAS VIBRATOR, 250 W×200 V×3-phase, controlled by inverter at vibration frequency of 37 Hz Vibration vane: effective area of 300×150 mm, thickness of 0.6 mm (six vibration vanes were used), $\alpha$=15 degrees (the lowermost vane were inclined downwardly and the other vanes were inclined upwardly)

Amplitude of vibration vane: 1.5 mm

Frequency of vibration vane: 600 times per minute

<Aeration Apparatus>

Three ceramic diffusing pipes were used.

Inner diameter: 50 mm

Outer diameter: 75 mm

Length: 450 mm

Porosity: 40%

Pore opening size: 2001 $\mu$m

As air blower for the diffusing pipes, a rotary air pump of 150 W having an air blowing rate of 120 liter/min was used.

<Swing Apparatus>

Geared motor or cylinder motor was used to generate the swing motion of the treatment target in the direction along the surface thereof with swinging amplitude of 40 mm and frequency of 20 times per minute.

<Vibration-Applying Apparatus>

Vibration motor 14 of 40 W was mounted to the swing support frame and operated via inverter at frequency of 30 Hz to vibrate the treatment target at frequency of 250 times per minute and amplitude of 0.8 mm.

<Anodizing Treatment Bath>

| | |
|---|---|
| Volume: | 150 liter |
| Surface level: | 400 mm on the bottom of the tank |
| Composition: | |
| $H_2SO_4$ | 200 g/liter |
| Aluminum | 4 g/liter |

<Heat Exchanger for Cooling Treatment Bath>

NEW COOL LINER SA3-2, cooling apparatus, manufactured by SHOWA ENTETSU CO., LTD., was used.

4010 Kcal/h, Motor 1.5 KW

<Circulation Pump for Heat Exchanger>

Maximum circulation rate: 120 liter/min

Output: 265 W, 1.27 A

The steps of the method were the same as the above Table 1, however, the following specific treament bathes were used with the following respective treatment time:

Degreasing Bath

Hydrogen carbonate degreasing agent such as naphtene degreasing agent (TECHNO CLEAN S800) was used. Temperature was 40° C. and treament time was 5 minutes. The inner size of the degreasing tank was 500 mm in width, 750 mm in length and 550 mm in height.

Ectching Bath

Sulfuric acid (specific gravity of 1.84) 500 m. liter/liter

Phosphoric acid (specific gravity of 1.74) 100 m. liter/liter

Chromic acid 30 g/liter

The temperature was 65° C. and the treament time was 10 minutes. The inner size of the etching tank was 500 mm in width, 750 mm in length and 550 mm in height.

Desmutting Bath $HNO_3$ 5% aqueous solution

Sealing Bath

Ion-exchanged, boiled water

The result is shown in Table 6.

EXAMPLE 7-2

The anodizing process was performed in the same manner as Example 7-1 with the exception that the vibration-applying apparatus (C) and the swing apparatus (D) were not operated. The result is shown in Table 6.

TABLE 6

| | Example 7-1 | Example 7-2 |
|---|---|---|
| External appearence | good | good |
| Weathering properties [*9] | 500 h | 300 h |
| Dyeing properties [*4] | good uniformity | good uniformity |
| Corrosion resistance [*6] | 140 h | 96 h |

[*9] Weathering properties was determined by using a weatherometer based on JIS K5400.

EXAMPLE 8-1

The apparatus of type of FIGS. 4 to 8 was used. The size, capacity, etc. of each component apparatus were as follows:

<Anodizing Treatment Tank>

The tank having width of 500 mm, length of 1250 mm and height of 750 mm was used.

<Anodizing Treatment Bath>

| | |
|---|---|
| Volume: | 340 liter |
| Composition: | |
| $H_2SO_4$ | 200 g/liter |
| Aluminum | 4 g/liter |

<Treatment Target (Metal Body: Anode)>

Aluminum plate having size of 500 mm×200 mm×10 mm was used.

<Cathode>

Ten aluminum plates each having size of 500 mm×60 mm×20 mm were used so as to be arranged in parallel to each other in the vertical direction.

The treatment target and cathode were arranged in the analogous manner to the case shown in FIG. 18. One set of five cathodes were disposed in series at one side of the treatment target with the interval d2 of 100 mm, the other set of five cathodes were disposed in series at the other side of the treatment target with the interval d3 of 100 mm, and the interval d1 was 15 mm. The uppermost portion of the treatrment target was positioned lower by 70 mm than the level of the treatment bath, and the lowermost portion of the treatment target was positioned higher by 70 mm than the bottom of the treatment tank.

<Vibrationally Fluidly Stirring Apparatus (A)>

Vibration motor: URAS VIBRATOR, 400 W×200 V×3-phase, controlled by inverter at vibration frequency of 37 Hz Vibration vane: effective area of 300×150 mm, thickness of 0.6 mm (eight vibration vanes were used), $\alpha$=15 degrees (the lowermost vane were inclined downwardly and the other vanes were inclined upwardly)

Amplitude of vibration vane: 1.5 mm

Frequency of vibration vane: 600 times per minute

Two vibrationally fluidly stirring apparatuses (A) were used.

<Aeration Apparatus (B)>

Three ceramic diffusing pipes were used.

Inner diameter: 50 mm

Outer diameter: 75 mm

Length: 800 mm

Porosity: 40%

Pore opening size: 200 $\mu$m

Air blower for the diffusing pipes having air blowing rate of 200 liter/min was used.

<Swing Apparatus (D)>

Geared motor or cylinder motor was used to generate the swing motion of the treatment target in the direction along the surface thereof with swinging amplitude of 40 mm and frequency of 20 times per minute.

<Vibration-applying Apparatus (C)>

Vibration motor 14 of 40 W was mounted to the swing support frame and operated via inverter at frequency of 30 Hz to vibrate the treatment target at frequency of 250 times per minute and amplitude of 0.8 mm.

<Heat Exchanger for Cooling Treatment Bath>

COOL LINER, automatic, directly cooling type, rapid cooling apparatus, was used.

4010 Kcal/h, Motor 1.5 KW

<Circulation Pump for Heat Exchanger>

Magnet pump was used.

Maximum circulation rate: 120 liter/min

Maximum head: 8.6 m

Output: 265 W, 1.27 A

<Regulator>

Direct current source was used.

Rated-output: 60V-100 A, 6.0 KW

Alternating current input: 200 V, 21.2 A, 7.34 KVA

The steps of the method were the same as the above Table 1, wherein the apparatuses (A) to (D) were also used in the degreasing steps and the sealing steps.

The result is shown in Table 7.

EXAMPLE 8-2

The anodizing process was performed in the same manner as Example 8-1 with the exception that the vibration-applying apparatus (C) and the swing apparatus (D) were not operated. The result is shown in Table 7.

TABLE 7

| | Example 8-1 | Example 8-2 |
|---|---|---|
| External appearence | good | good |
| Weathering properties [*9] | 500 h | 300 h |
| Dyeing properties [*4] | good uniformity | good uniformity |
| Corrosion resistance [*6] | 140 h | 96 h |

EXAMPLE 9-1

The anodizing process was performed in the same manner as Example 8-1 wherein hard aluminum plate made of A5052P (JIS H 400) was used as the treatment target, temperature of the treatment bath was 7° C., current density was 15 A/cm$^2$ and treatment time was 10 minutes.

Figure 24:
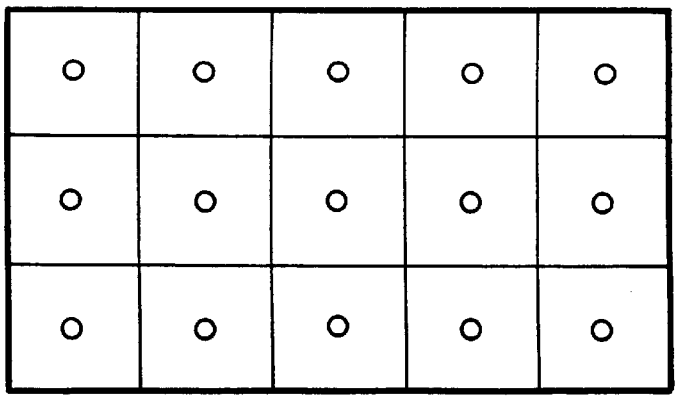
FIG. 24 shows a sectioning manner and measuring points in anodized aluminum plate when evaluating thickness and hardness of oxide film.

The aluminum plate thus treated was sectioned into 15 portions as shown in FIG. 24, and thickness and hardness of the oxide film at the center of each portion was measured, the measuring points being depicted with small circle ○ in FIG. 24. The result is shown in Tables 8 and 9.

TABLE 8

| (Thickness, μm) | | | | |
|---|---|---|---|---|
| 45.0 | 44.6 | 44.7 | 44.1 | 44.9 |
| 44.1 | 44.7 | 44.5 | 44.4 | 44.9 |
| 45.2 | 44.9 | 44.7 | 44.5 | 44.7 |

The average thickness value: 44.7 μm

The minimum thickness value: 44.1 μm

The maximum thickness value: 45.2 μm

TABLE 8

| (Hardness, Hv) | | | | |
|---|---|---|---|---|
| 519 | 509 | 520 | 527 | 511 |
| 519 | 514 | 521 | 526 | 516 |
| 512 | 512 | 516 | 520 | 512 |

The average hardness value: 518

The minimum hardness value: 511

The maximum hardness value: 527

EXAMPLE 9-2

The anodizing process was performed in the same manner as Example 9-1 with the exception that the vibration-applying apparatus (C) and the swing apparatus (D) were not operated. The result is shown in Tables 10 and 11.

TABLE 10

| (Thickness, μm) | | | | |
|---|---|---|---|---|
| 37.3 | 36.7 | 36.7 | 36.8 | 37.1 |
| 37.4 | 36.4 | 36.0 | 35.7 | 37.2 |
| 38.0 | 37.0 | 37.3 | 37.4 | 37.8 |

The average thickness value: 37.0 μm

The minimum thickness value: 35.7 μm

The maximum thickness value: 38.0 μm

TABLE 11

| (Hardness, Hv) | | | | |
|---|---|---|---|---|
| 405 | 400 | 411 | 401 | 397 |
| 401 | 398 | 406 | 410 | 400 |
| 410 | 401 | 415 | 402 | 402 |

The average hardness value: 404

The minimum hardness value: 397

The maximum hardness value: 415

As can be seen by comparing Tables 8 and 9 with Tables 10 and 11, the anodizing process performed with operating all the apparatuses (A) to (D) is superior to the anodizing process performed with operating the apparatuses (A) and (B) without operating the apparatuses (C) and (D). In fact, as compared with the oxide film obtained in Example 9-2, the oxide film obtained in Example 9-1 has thickness greater by about 20% with higher uniformity and has Vickers hardness by about 30%, although both Examples 9-1 and 9-2 were performed with the same temperature of the treatment bath and the same treatment time.

If the anodizing process is performed with operating the apparatuses (A) to (C) without operating the apparatus (D), thickness of the oxide film obtained becomes a value between those of Example 9-1 and Example 9-2 while Vickers hardness of the oxide film becomes substantially the same value as that of Example 9-1.

If the anodizing process is performed with operating the apparatuses (A), (B) and (D) without operating the apparatus (C), Vickers hardness of the oxide film obtained becomes a value between those of Example 9-1 and Example 9-2 while thickness of the oxide film becomes substantially the same value as that of Example 9-1.

It has been found out that the use of apparatus (D) is advantageous in improving smoothness and uniformity of the surface of the oxide film especially in case of the plate-like treatment target.

EXAMPLE 10

The apparatus of type of FIGS. 1 to 3 was used. The size, capacity, etc. of each component apparatus were as follows:

(1) Anodizing Treatment Tank

The tank made of heat-resistant polyvinyl chloride and having width of 700 mm, length of 1000 mm and height of 700 mm was used.

(2) Vibrationally Fluidly Stirring Apparatus

SUPERVIBRATING α AGITATOR Type 5, manufactured by JAPAN TECHNO CO., LTD., was used.

Vibration motor: URAS VIBRATOR KEE 10-2B, 750 W×200 V×3-phase, controlled by an inverter (1 kW)

Vibration vane: effective area of 300×150 mm, thickness of 0.6 mm (six vibration vanes were used), α=15 degrees (the lowermost vane were inclined downwardly and the other vanes were inclined upwardly)

Amplitude of vibration vane: 1.5 mm

Frequency of vibration vane: 700 times per minute (3) Diffusing Pipe

MICRO AERATOR BM-100 made of ceramics, manufactured by JAPAN TECHNO CO., LTD., was used. Three diffusing pipes were used.

Inner diameter: 50 mm

Outer diameter: 75 mm

Length: 700 mm

Porosity: 33 to 38%

Pore opening size: 50 to 60 μm

Bulk specific gravity: 2.2 to 2.5

(4) Air Blower for Diffusing Pipe:

Rotary air pump of 150 W was used.

Air blowing rate: 120 liter/min (5) Anodizing Treatment Bath:

| | |
|---|---|
| Volume: | 420 liter |
| Composition: | |
| $H_2SO_4$ | 200 g/liter |
| Aluminum | 4 g/liter |

(6) Cathode

Ten aluminum plates were used.

(7) Treatment Target (Metal Body: Anode)

Aluminum body manufactured by casting, a part of automobile, having size of 250 mm×750 mm×500 mm and having numerous depressions on the surface was used.

(8) Heat Exchanger for Cooling Treatment Bath

COOL LINER, cooling apparatus, was used.

4010 Kcal/h, Motor 1.5 KW (9) Circulation Pump for Heat Exchanger

Magnet pump, IWAKI MD-100RM, was used.

Maximum circulation rate: 120 liter/min

Maximum head: 8.6 m

Output: 265 W, 1.27 A

(10) Regulator

Direct current source, HI-MINI MB7C-600-01, manufactured by CHUO EISAKUSHO CO., LTD., was used.

Rated-output: 60V-100 A, 6.0 KW

Alternating current input: 200 V, 21.2 A, 7.34 KVA

(11) Interval Between Anode and Cathode (d2, d3 in FIG. 18)

100 mm

(12) Arrangement of Treatment Tanks

Degreasing tank→Water washing tank→Etching tank→Water washing tanks→Desmutting tank→Water washing tank→Anodizing tank→Water washing tank→Sealing tank→Drying tank Etching treatment: bath of caustic soda 50 g/liter, treatment time of 5 minutes under the room temperature Desmutting treatment: bath of 5% nitric acid solution, treatment time of 1 minute under the room temperature Sealing treatment: bath of ion-exchanged boiled water, treatment time of 30 minutes under the room temperature Current density: 5 A/dm$^2$ The anodizing treatment was performed during 8 minutes under the condition of frequency of the vibration motor of the apparatus (A) of 40 Hz, bath temperature of 30° C., air blowing rate of 120 liter/min.

Anodic oxide film having average thickness of 20 $\mu$m was formed on the surface of the treatment target. Thickness of the oxide film was good in uniformity.

If the anodizing process is performed without operating the vibrationally fluidly stirring apparatus (A), the burning of the oxide film occurs and the good anodic oxide film cannot be obtained.

EXAMPLE 11

The anodizing process was performed in the same manner as Example 10 with the exception of the following:

(1) Size of the treatment target was 100 mm×500 mm×300 mm.

(2) MICRO AERATOR B-100 made of ceramics, manufactured by JAPAN TECHNO CO., LTD., was used. Three diffusing pipes were used.

Inner diameter: 50 mm

Outer diameter: 70 mm

Length: 500 mm

Porosity: 33 to 38%

Pore opening size: 50 to 60 $\mu$m

The anodizing treatment was performed during 5 minutes under the condition of bath temperature of 30° C., air blowing rate of 120 liter/min.

Anodic oxide film having thickness of 15 $\mu$m was formed on the surface of the treatment target. Thickness of the oxide film was good in uniformity even in the depressions.

If the anodizing process is performed without operating the vibrationally fluidly stirring apparatus (A), the air blowing rate higher than 60 liter/min results in that the uniformity in thickness of the oxide film is lost, and thus the air blowing rate higher than 60 liter/min cannot be employed practically. Furthermore, if the higher current density is employed, the burning of the oxide film tends to occur and therefore the current density cannot be increased to the extent of obtaining the sufficient anodizing rate.

What is claimed is:

1. An anodizing method of a metal body, comprising an anodizing treatment process in which an anodic oxide film is formed on a surface of the metal body immersed in a treatment bath, the anodizing treatment process being performed while simultaneously performing the steps of (A) through (D):

(A) providing a stirring apparatus for the treatment bath, wherein said stirring apparatus comprises a vibration generating means containing a vibration motor, a vibrationally fluidly stirring means for vibrating a vibration vane at an amplitude of 0.5 to 3.0 mm and at a vibrational frequency of 200 to 800 times per minute to generate vibrational flow in the treatment bath, the vibration vane being fixed in one stage or in multistage to a vibrating bar which vibrates in the treatment bath interlockingly with the vibration generating means, and a vibration stress dispersing means at a connection portion of the vibration generating means and the vibrationally fluidly stirring means;

(B) vibrationally fluidly stirring the treatment bath with said stirring apparatus;

(C) providing a diffuser for the treatment bath where said diffuser comprises a ceramic diffusing pipe having a pore size of 10 to 400 $\mu$m and a porosity of 30 to 40%; and (D) aerating the treatment bath with said diffuser.

2. An anodizing method as claimed in claim 1, wherein the stirring apparatus further comprises an inverter for controlling the vibration motor of the stirring apparatus to generate any frequency in the range from 10 to 500 Hz.

3. An anodizing method as claimed in claim 1, wherein the anodizing treatment process is performed while simultaneously performing the steps of (E) and (F):

(E) providing a vibration apparatus;

(F) vibrating the metal body with said vibration apparatus through an electrode bar on which the metal body is hung in an amplitude from 0.5 to 1.0 mm and at a frequency of 100 to 300 times per minute.

4. An anodizing method as claimed in claim 3, wherein the vibration apparatus applies vibration to the metal body by using a vibration motor whose frequency is adjusted to 10 to 60 Hz by an inverter.

5. An anodizing method as claimed in claim 1, wherein the anodizing treatment process is performed while simultaneously performing the steps of (G) and (H):

(G) providing a swinging apparatus;

(H) swinging an electrode bar with said swinging apparatus for suspending the metal body thereon, which generates a swinging motion of the metal body at a swinging amplitude of 10 to 100 mm and a frequency of 10 to 30 times per minute through the electrode bar.

6. An anodizing method as claimed in claim 1, wherein the anodizing treatment process is performed while steps (E) through (H) are simultaneously performed:

(E) providing a vibration apparatus;

(F) vibrating a metal body with said vibration apparatus through an electrode bar on which the metal body is hung in an amplitude from 0.5 to 1.0 mm and at a frequency of 100 to 300 times per minute;

(G) providing a swinging apparatus;

(H) swinging an electrode bar with said swinging apparatus for suspending the metal body thereon, which generates a swinging motion of the metal body at a swinging amplitude of 10 to 100 mm and a frequency of 10 to 30 times per minute through the electrode bar.

7. An anodizing method as claimed in any one of claims 1 to 6, wherein the method comprises a pre-treatment process performed before the anodizing treatment process, said pre-treatment process including a degreasing step, a washing step, an etching step, and a desmutting step and/or a post-treatment process performed after the anodizing treatment process, said post-treatment process including a washing step, a sealing step and a drying step, and at least one step included in the pre-treatment process or the post-treatment process is performed while the process steps of (A) and (B) are being performed.

8. An anodizing method as claimed in claim 7, wherein the at least one step is performed while the process steps of (C) and (D) are being simultaneously performed.

9. An anodizing method as claimed in claim 7, wherein the at least one step is a degreasing step, a polishing step of electrolytic polishing or chemical polishing, or a hot water sealing step.

10. An anodizing method as claimed in claim 8, wherein the at least one step is performed while either process steps (E) and (F) or process steps (G) and (H) are being simultaneously performed.

11. An anodizing method as claimed in claim 8, wherein the at least one step is a degreasing step, a polishing step of electrolytic polishing or chemical polishing, or a hot water sealing step.

12. An anodizing method as claimed in claim 10, wherein the at least one step is a degreasing step, a polishing step of electrolytic polishing or chemical polishing, or a hot water sealing step.

13. An anodizing method as claimed in any one of claims 1–6, wherein the metal body has a blind hole having a diameter equal to or less than 10 mm or a through hole having a diameter equal to or less than 10 mm.

14. An anodizing apparatus for a metal body for performing an anodizing treatment process in which an anodic oxide film is formed on a surface of the metal body immersed in a treatment bath, comprising the following apparatuses (A) and (B):

(A) a vibrationally fluidly stirring apparatus for the treatment bath, which comprises a vibration generating means containing a vibration motor, a vibrationally fluidly stirring means for vibrating a vibration vane at an amplitude of 0.5 to 3.0 mm and at a vibrational frequency of 200 to 800 times per minute to generate vibrational flow in the treatment bath, the vibration vane being fixed in one stage or in multistage to a vibrating bar which vibrates in the treatment bath interlockingly with the vibration generating means, and a vibration stress dispersing means at a connection portion of the vibration generating means and the vibrationally fluidly stirring means; and (B) an aeration apparatus for the treatment bath, which comprises a ceramic diffusing pipe having a pore-size of 10 to 400 $\mu$m and porosity of 30 to 40%.

15. An anodizing apparatus as claimed in claim 14, wherein the apparatus (A) further comprises an inverter for controlling the vibration motor of the apparatus (A) to generate any frequency in the range from 10 to 500 Hz.

16. An anodizing apparatus as claimed in claim 14, further comprising the following apparatus (C):

(C) an apparatus for applying vibration to the metal body through an electrode bar on which the metal body is hung in an amplitude from 0.5 to 1.0 mm and at a frequency of 100 to 300 times per minute.

17. An anodizing apparatus as claimed in claim 14, wherein the apparatus (C) applies vibration to the metal body by using a vibration motor whose frequency is adjusted to 10 to 60 Hz by an inverter.

18. An anodizing apparatus as claimed in claim 14, further comprising the following apparatus (D):

(D) an apparatus for swinging an electrode bar for suspending the metal body thereon, which generates a swinging motion of the metal body at a swinging amplitude of 10 to 100 mm and a frequency of 10 to 30 times per minute through the electrode bar.

19. An anodizing apparatus as claimed in claim 14, further comprising the following apparatuses (C) and (D):

(C) an apparatus for applying vibration to the metal body through an electrode bar on which the metal body is hung in an amplitude from 0.5 to 1.0 mm and at a frequency of 100 to 300 times per minute; and (D) an apparatus for swinging an electrode bar for suspending the metal body thereon, which generates a swinging motion of the metal body at a swinging amplitude of 10 to 100 mm and a frequency of 10 to 30 times per minute through the electrode bar.

* * * * *